US007278698B2

(12) United States Patent
Tamura

(10) Patent No.: US 7,278,698 B2
(45) Date of Patent: Oct. 9, 2007

(54) LIQUID EJECTION APPARATUS, LIQUID EJECTION HEAD THEREOF, AND LIQUID EJECTION METHOD

(75) Inventor: Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 388 days.

(21) Appl. No.: 10/917,516

(22) Filed: Aug. 13, 2004

(65) Prior Publication Data

US 2005/0083359 A1 Apr. 21, 2005

(30) Foreign Application Priority Data

Aug. 13, 2003 (JP) ..... P. 2003-293169
Aug. 12, 2004 (JP) ..... P. 2004-235095

(51) Int. Cl.
*B41J 29/38* (2006.01)

(52) U.S. Cl. ..... 347/11; 347/10

(58) Field of Classification Search ..... 347/11
See application file for complete search history.

(56) References Cited

U.S. PATENT DOCUMENTS 5,469,267 A * 11/1995 Wang ..... 358/3.21
6,758,544 B2 * 7/2004 Fukano ..... 347/9
2002/0018085 A1 * 2/2002 Asauchi et al. ..... 347/10

FOREIGN PATENT DOCUMENTS

JP 9-11457 A 1/1997
JP 10-81013 A 3/1998

* cited by examiner

*Primary Examiner*—Matthew Luu
*Assistant Examiner*—Brian J. Goldberg
(74) *Attorney, Agent, or Firm*—Sughrue Mion, PLLC

(57) ABSTRACT

A liquid ejection apparatus includes a driving signal generating section which generates plural driving signals each having at least one or more driving pulses; a driving pulse selecting section which selectively combines the driving pulses of the driving signals with each other; and driving elements which are disposed to respectively correspond to plural nozzles, and which conduct a driving operation to eject liquid droplets from the nozzles on the basis of the combined driving pulses.

14 Claims, 13 Drawing Sheets

| q0' | q4' | Q0 |
|---|---|---|
| 1 | 1 | VDD |
| 0 | 1 | 2/3 VDD |
| 1 | 0 | 1/3 VDD |
| 0 | 0 | 0 |

LIQUID EJECTION APPARATUS, LIQUID EJECTION HEAD THEREOF, AND LIQUID EJECTION METHOD

BACKGROUND OF THE INVENTION

The present invention relates to a liquid ejection apparatus which can eject liquid droplets of different sizes from the same nozzle, and more particularly to a liquid ejection apparatus which can eject plural liquid droplets in one ejection period.

A liquid ejection apparatus is used in various apparatuses such as: a recording device which is useful in an image recording apparatus; a color material spraying apparatus which is useful in the production of a color filter for a liquid crystal display device; an electrode material (electrically conductive paste) spraying apparatus which is useful in the formation of electrodes in an organic EL display device, an FED (surface light emitting display device), or the like; a bio-organic substance spraying apparatus which is useful in the production of biochips, and a sample spraying apparatus serving as a precision pipette. An ink jet recording apparatus will be described as an example of a liquid ejection apparatus.

As an output apparatus for a computer, recently, a color ink jet printer in which inks of several colors are ejected from a print head is widely used for printing an image processed by a computer in multi-color and multi-gray scale levels.

An ink jet printer has a print head in which many nozzles are arranged in a sub-scanning direction (sheet feeding direction). The print head is moved in a main scanning direction by a carriage mechanism, and a sheet is fed by a predetermined degree in the sub-scanning direction, thereby obtaining a desired print result. Based on a dot pattern data which is obtained by expanding a print data supplied from a host computer, ink droplets are ejected at respective predetermined timings from the nozzles of the print head, and the ink droplets impact a print recording medium such as a recording sheet to adhere therewith, whereby a printing process is conducted. As described above, in an ink jet printer, it is controlled whether ink droplets are ejected or not, i.e., a dot on/off control is conducted. When no countermeasure is taken, therefore, an intermediate gray scale such as gray cannot be printed out.

Recently, an ink jet printer is therefore used in which plural liquid droplets of different weights are ejected from the same nozzle to variably control the diameter of a recording dot. In a first related ink jet printer, for example, a common waveform generating device generates plural driving voltage waveforms corresponding to ink ejection amounts, one of the driving voltage waveforms is selected in accordance with a gray-scale data signal, and the selected driving voltage waveform is applied to a piezoelectric element (see JP-A-9-11457).

In a second related ink jet printer, by contrast, a driving signal which is output in each print period is configured by plural driving pulses, one or more of the driving pulses are time-divisionally selected by a print data having pulse selecting signals respectively corresponding to the driving pulses, and the selected driving pulses are applied to a piezoelectric element (see JP-A-10-81013).

In the first related example, analog switches of a transmission gate (hereinafter, referred to simply as TG) in a print head are required in a number which is equal to the product of the number of the driving voltage waveforms x that of nozzles. Therefore, an integrated circuit (hereinafter, referred to simply as IC) in which the TG is formed is inevitably increased in size. As a result, also the size of a print head is enlarged, and the production cost is raised.

In the second related example, the driving signal which is output in each print period is configured by plural driving pulses, one or more of the driving pulses are time-divisionally selected, and the selected driving pulses are applied to the piezoelectric element. Therefore, a head is hardly driven in accordance with a high frequency.

SUMMARY OF THE INVENTION

It is an object of the invention to provide a head driving technique for a liquid ejection apparatus in which it is not required to use a large IC for a transmission gate (TG) in a liquid ejection head, and the liquid ejection head can be driven with a short ejection period.

In order to attain the object, the liquid ejection apparatus according to the invention, comprising:

a driving signal generating section which generates plural driving signals each having at least one or more driving pulses;

a driving pulse selecting section which selectively combines the driving pulses of the driving signals with each other; and driving elements which are disposed to respectively correspond to plural nozzles, and which conduct a driving operation to eject liquid droplets from the nozzles on the basis of the combined driving pulses.

Preferably, the liquid ejection apparatus further includes a driving pulse selecting signal generating section which generates a driving pulse selecting signal according to an input data.

For example, the liquid ejection apparatus of the invention is a liquid ejection apparatus in which driving elements that are disposed to respectively correspond to plural nozzles are operated on the basis of an input gray-scale data, thereby ejecting liquid droplets from the nozzles, wherein a first driving signal (A) including at least first and second driving pulses, and a second driving signal (B) including at least first and second driving pulses are generated, and, in accordance with the gray-scale data, the first and second driving pulses of the first driving signal (A) and the second driving signal (B) are supplied to the driving elements with being selectively combined with each other in one ejection period.

According to the configuration, it is not required to use a large IC for a transmission gate (TG) in a liquid ejection head, and the liquid ejection head can be driven with a short ejection period.

Preferably, the driving pulse selecting section does not select plural driving pulses at a same time.

According to the configuration, during the waveform selection, the driving pulse selecting section does not select the first driving signal (A) and the second driving signal (B) at the same time, and hence the transmission gate (TG) can be prevented from being broken.

Preferably, the driving pulse selecting section selectively combines the driving pulses of the driving signals with each other on the basis of the driving pulse selecting signal, and the combination of the driving pulse selecting signal and the driving pulses of the driving signals is determined on the basis of a program data.

According to the configuration, the combination of the driving pulse selecting signal (gray-scale value) and the driving pulses can be freely set by changing the program data. When a logic section is incorporated into an IC, therefore, the liquid ejection apparatus can cope with several kinds of apparatuses having various pulse patterns. Since the program data can be rewritten during when the apparatus is being operated, the liquid ejection apparatus can be applied to, for example, a gray-scale printer which is designed so that the driving pulse pattern is changed during operation.

Preferably, the liquid ejection apparatus further comprises a logic circuit constituting a logic in which plural diving pulses are not selected at a same time.

According to the configuration, it is possible to prevent plural diving pulses from colliding with each other. Even when noises of some kind are applied to the driving pulses during a transfer process, therefore, the transmission gate (TG) can be prevented from being broken.

Preferably, the driving pulse selecting signal consists of a multi-level digital signal.

According to the configuration, the logic section can be simplified, and the number of pins in the case where the logic section is incorporated into an IC can be reduced.

Preferably, the driving pulse selecting section is turned off in accordance with a disable signal to be disabled from selecting the driving pulses.

Preferably, a first driving signal of the driving signals includes a first driving pulse for ejecting a first liquid droplet, and a second driving pulse for ejecting a second liquid droplet which is equal in amount to the first liquid droplet, and a second driving signal of the driving signals includes a third driving pulse for ejecting a third liquid droplet which is smaller in amount than the first and second liquid droplets.

Preferably, the driving elements are piezoelectric vibrators.

A liquid ejection head driving apparatus for a liquid ejection apparatus which is provided by the invention comprises:

a driving pulse selecting section which selectively combines predetermined driving pulses from plural driving signals each having at least one or more driving pulses; and driving elements which are disposed to respectively correspond to plural nozzles, and which conduct a driving operation to eject liquid droplets from the nozzles on the basis of the combined driving pulses.

A liquid ejection method which is provided by the invention comprises the steps of:

generating plural driving signals each having at least one or more driving pulses;

selectively combining the driving pulses of the driving signals with each other; and ejecting liquid droplets from plural nozzles on the basis of the combined driving pulses.

Preferably, the liquid ejection method further comprises a step of generating a driving pulse selecting signal according to an input data.

Preferably, in the step of combining the driving pulses, plural driving pulses are not selected at a same time.

Preferably, in the step of combining the driving pulses, the driving pulses of the driving signals are selectively combined with each other on the basis of the driving pulse selecting signal, and the combination of the driving pulse selecting signal and the driving pulses of the driving signals is determined on the basis of a program data.

BRIEF DESCRIPTION OF THE DRAWINGS

The above and other objects and effects of the invention will become more apparent from the following detailed description of preferred embodiments with reference to the accompanying drawings in which.

DETAILED DESCRIPTION OF THE PREFERRED EMBODIMENTS

Figure 1:
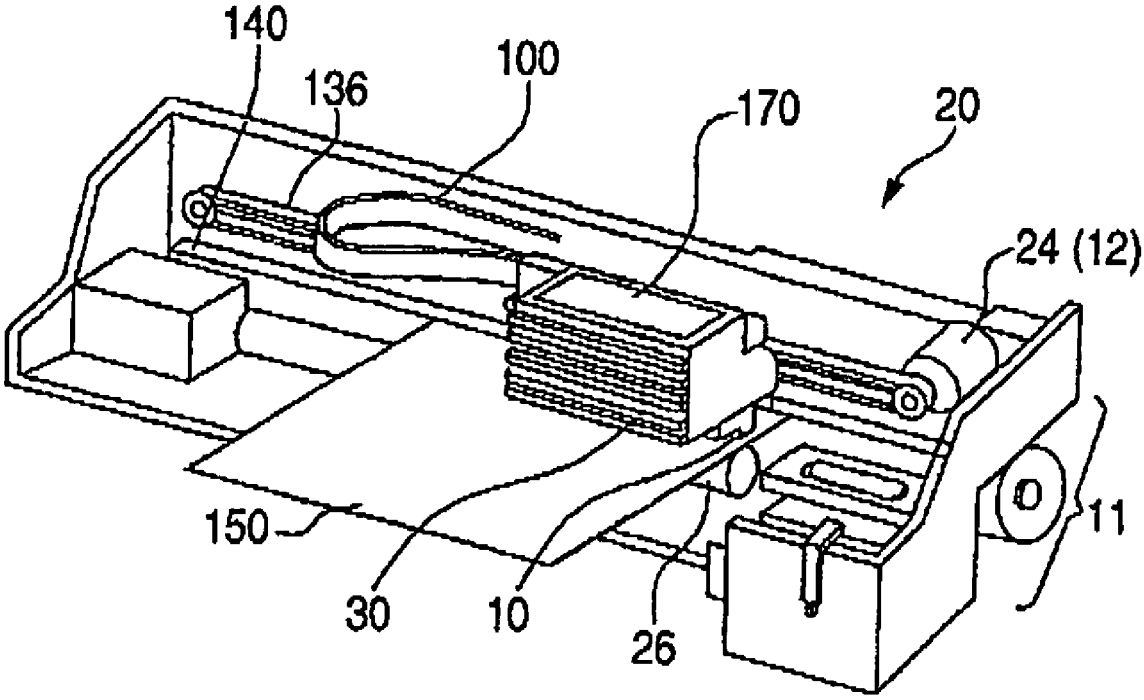
FIG. 1 is a perspective view schematically showing the configuration of an ink jet printer according to a first embodiment of the invention.

Hereinafter, embodiments of the invention will be described in detail with reference to the accompanying drawings. First, an ink jet printer of a first embodiment of the invention will be described. FIG. 1 is a perspective view schematically showing the configuration of the ink jet printer of the embodiment of the invention.

As shown in FIG. 1, the ink jet printer 20 of the embodiment is configured so that a carriage 30 is coupled via a timing belt 136 to a carriage motor 24 of a carriage mechanism 12, and guided by a guide member 140 to be reciprocally moved in the width direction of a printing sheet 150. In the ink jet printer 20, also a sheet feeding mechanism 11 using a sheet feed roller 26 is formed. An ink jet print head 10 is attached to a face of the carriage 30 which is opposed to the printing sheet 150, or the lower face in the illustrated example. The print head 10 is supplied with inks from an ink cartridge 170 which is placed on the carriage 30, and ejects ink droplets of various colors onto the printing sheet 150 in accordance with the movement of the carriage 30 to form dots, thereby printing images or characters onto the printing sheet 150.

In the first embodiment, the print head 10 includes nozzle rows for ejecting inks of seven colors of cyan (C), magenta (M), yellow (Y), black (K), light cyan (LC), light magenta (LM), and dark yellow (DY). Each of the color ink nozzle rows has 96 ejection nozzles in the vertical (sub-scanning) direction. As shown in FIG. 1, the print head 10 is circuit-connected to a main unit of the printer apparatus via a flexible flat cable (hereinafter, referred to as FFC) 100. The FFC 100 is set to be slightly longer so as not to disturb the movement of the carriage 30.

Figure 2:
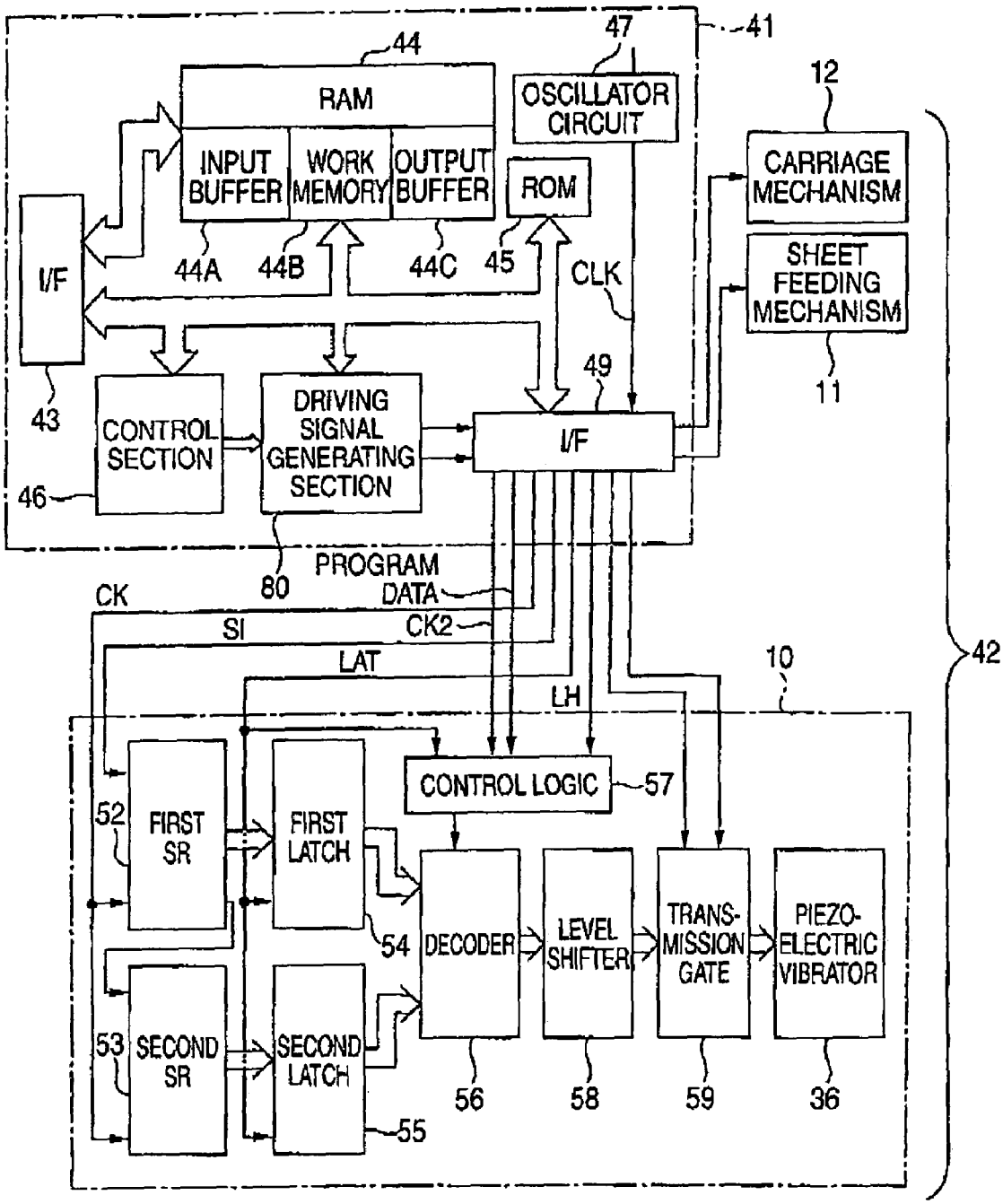
FIG. 2 is a functional block diagram of the ink jet printer shown in FIG. 1.

Next, the electrical configuration of the ink jet printer 20 of the embodiment will be described. FIG. 2 is a functional block diagram of the ink jet printer 20. As shown in FIG. 2, the ink jet printer 20 includes a printer controller 41 and a print engine 42.

The printer controller 41 includes, an interface (hereinafter, referred to as external I/F) 43 which receives data such as a print data from a host computer and the like which are not shown; a RAM 44 which stores various data; a ROM 45 which sores routines for processing various data, and the like; a control section 46 having a CPU and the like; an oscillator circuit 47 which generates a clock signal (CK); a driving signal generating section 80 which generates driving signals (COMA, COMB) to be supplied to the print head 10; and an interface (hereinafter, referred to as internal I/F) 49 which transmits to the print engine 42 a dot print data (SI), a program (pattern) data (SP), a driving signal, and the like that will be described in detail later.

Figure 3:
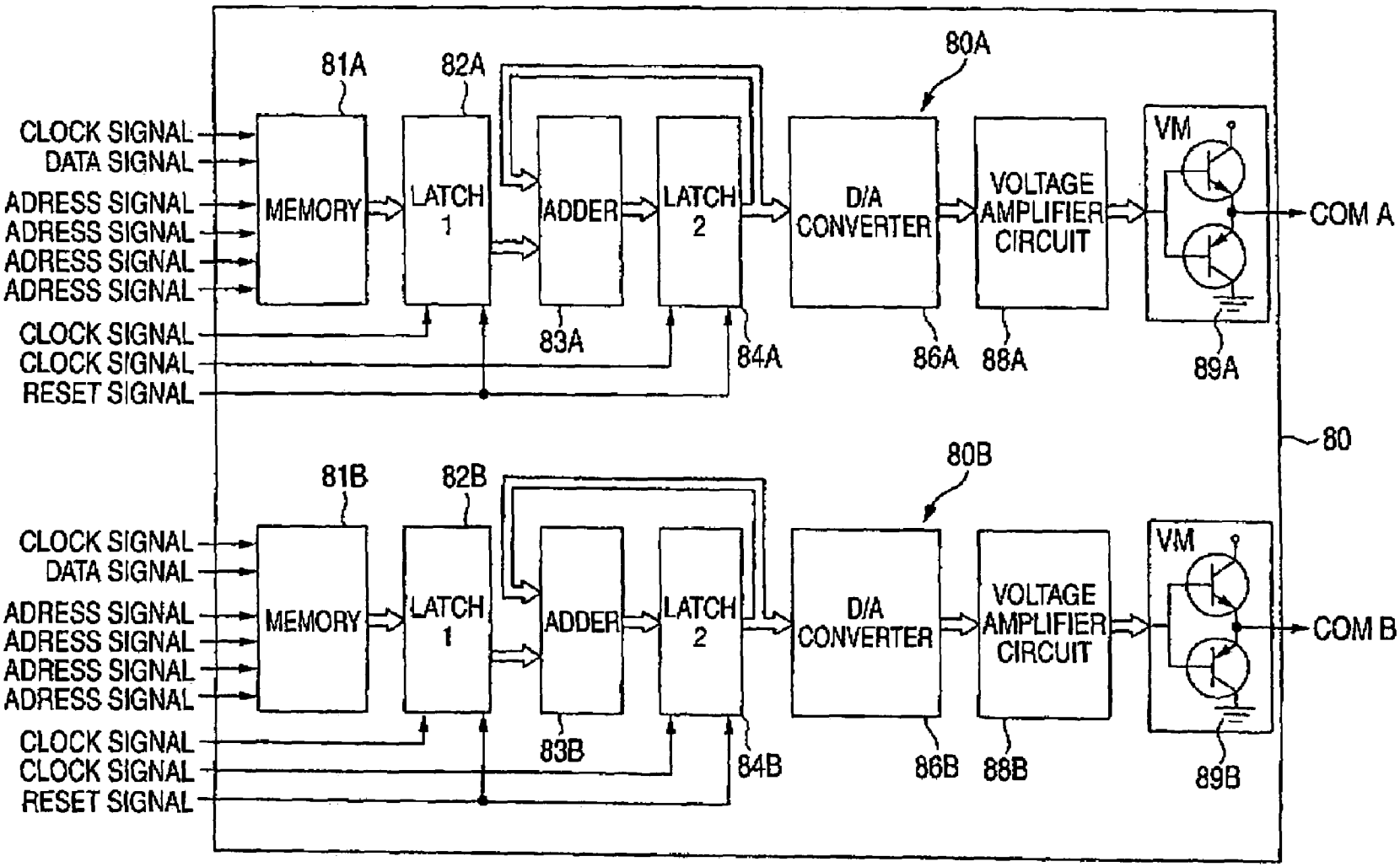
FIG. 3 is a functional block diagram showing the configuration of a driving signal generating section of the ink jet printer shown in FIG. 2.

As shown in FIG. 3, the driving signal generating section 80 has a first driving signal generating circuit 80A and a second driving signal generating circuit 80B, and generates and outputs the different driving signals COMA, COMB as described later.

The external I/F 43 receives from the host computer and the like a print data consisting of one or more of, for example, a character code, a graphic function, and an image data. The external I/F 43 outputs signals such as a busy signal (BUSY) and an acknowledge signal (ACK) to the host computer.

The RAM 44 is used as an input buffer 44A, an output buffer 44C, a work memory 44B, etc. The input buffer 44A temporarily stores the print data which is received from the host computer and the like by the external I/F 43. In the output buffer 44C, the dot print data (SI) which is a print image data to be serially transferred to the print head 10 is expanded. The dot print data (SI) is a print image data which is obtained by, in the output buffer 44C, expanding a print data included in a print signal supplied from the host computer (not shown) and the like The dot print data is separately transferred to each of the nozzle rows The ROM 45 stores various control routines to be executed by the control section 46, font data, graphic functions, various procedures, etc.

The control section 46 expands the print data to the dot print data, or reads out and analyzes the print data in the input buffer 44A, and expands the print data to a plural-bit tot print data with reference to the font data and graphic functions in the ROM 45.

In the embodiment, the dot print data is configured by a 2-bit data as described later. The expanded dot print data is stored into the output buffer 44C. When a dot print data corresponding to one line of the print head 10 is obtained, the dot print data (SI) of one line is serially transferred to the print head 10 via the internal I/F 49.

The control section 46 supplies a latch signal (LAT) and a channel signal (CH) to the print head 10 via the internal I/F 49. The latch signal and the channel signal define supply start timings of first and second driving pulses constituting each of the driving signals (COMA, COMB), or, for the driving signal COMA, first and second driving pulses ADP1 and ADP2, and, for the driving signal COMB, first and second driving pulses BDP1 and BDP2.

The print engine 42 is configured by the sheet feeding mechanism 11, the carriage mechanism 12, and the print head 10. As described with reference to FIG. 1, the sheet feeding mechanism 11 consists of a sheet feed motor (not shown), the sheet feed roller 26, and the like, and gradually feeds a recording medium such as the printing sheet 150 to conduct the sub-scanning operation. The carriage mechanism 12 consists of the carriage 30 on which the print head 10 is mounted, the carriage motor 24 which causes the carriage 30 to run, via the timing belt 136, and the like, and applies the main scanning operation on the print head 10.

The print head 10 includes a mechanical structure including the nozzle row structure, pressure chambers, and an ink flow system, and also a driving circuit system. The driving circuit system of the print head 10 includes a shift register consisting of firsthand second shift registers 52 and 53, a latch circuit consisting of first and second latch circuits 54 and 55, a decoder 56, a control logic 57, a level shifter 58, a transmission gate 59, and a piezoelectric vibrator 36. The shift registers 52, 53, the latch circuits 54, 55, the decoder 56, the transmission gate 59, and the piezoelectric vibrator 36 are disposed in plural so as to correspond to nozzle openings of the color ink nozzle rows of the print head 10.

Figure 4:
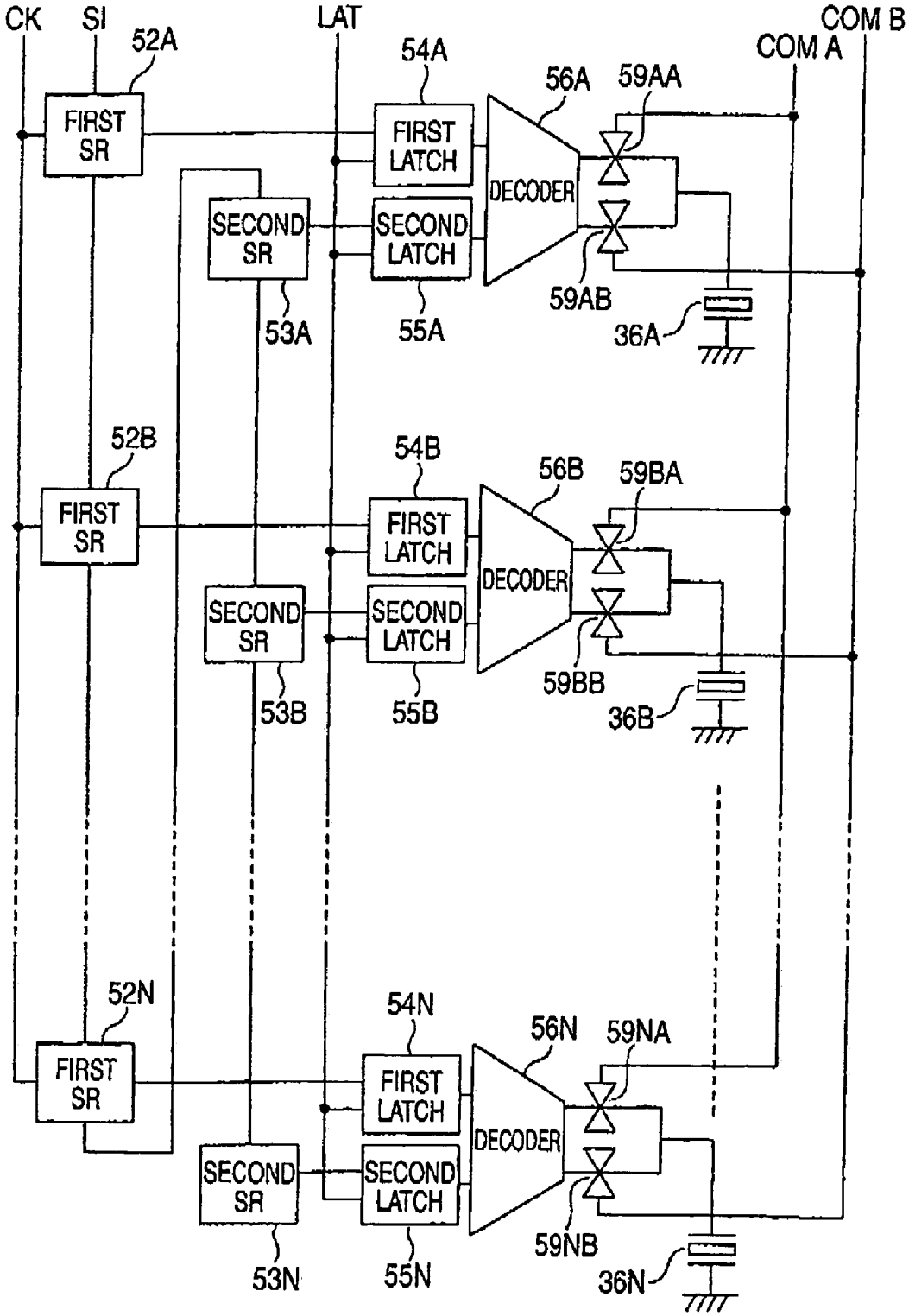
FIG. 4 is a circuit diagram showing main portions of a print head driving circuit.

As shown in FIG. 4, for example, each of the nozzle rows for inks of seven colors of [C (cyan), M (magenta), Y (yellow), K (black), LC (light cyan), LM (light magenta), and DY (dark yellow)] is configured by first shift registers 52A to 52N, second shift registers 53A to 53N, first latch circuits 54A to 54N, second latch circuits 55A to 55N, decoders 56A to 56N, transmission gates 59A to 59N, and piezoelectric vibrators 36A to 36N. Although the level shifter 58 (see FIG. 2) is omitted in FIG. 3, also plural level shifters 58 are similarly disposed.

The print head 10 ejects ink droplets on the basis of the dot print data (SI) supplied from the printer controller 41. Namely, the dot print data (SI) supplied from the printer controller 41 is serially transmitted from the internal I/F 49 to the first and second shift registers 52 and 53 in synchronization with the clock signal (CK) supplied from the oscillator circuit 47. The dot print data (SI) is a 2-bit data, and configured by gray-scale information indicative of four gray-scale levels of unrecording, a small dot, a medium dot, and a large dot. In the embodiment, the unrecording is indicated by gray-scale information (00), the small dot is indicated by gray-scale information (10), the medium dot is indicated by gray-scale information (01), and the large dot is indicated by gray-scale information (11).

Figure 5:
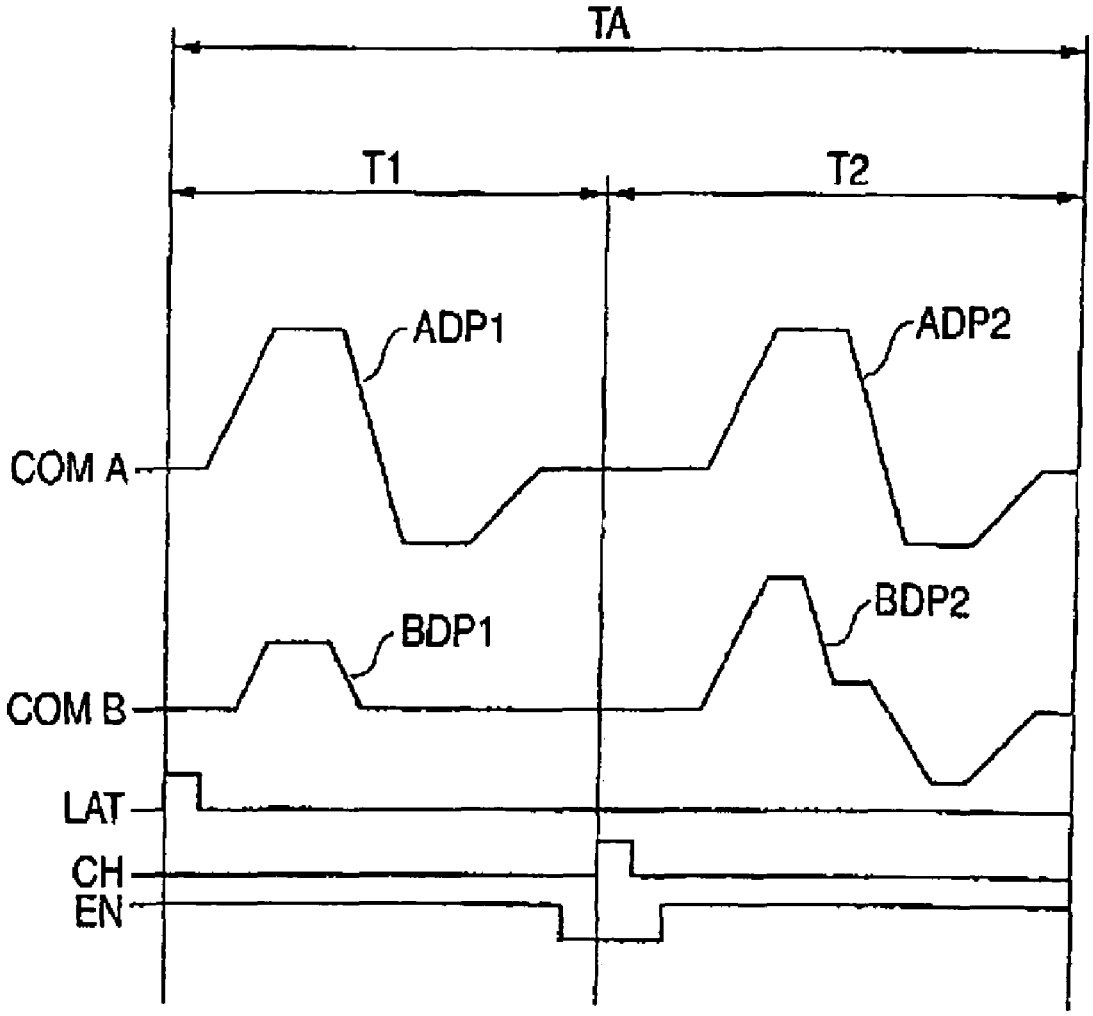
FIG. 5 is a time chart showing generation timings of driving signals COMA and COMB, a latch signal LAT, a channel signal CH, and an enable signal EN.

The dot print data (SI) is set for each of the nozzle openings. With respect to all of the nozzle openings, a data of the low order bit (L) such as shown in FIG. 5 is input to the first shift register 52 (52A to 52N). With respect to all of the nozzle openings, similarly, a data of the high order bit (H) is input to the second shift register 53 (53A to 53N).

As shown in FIG. 2, the first latch circuit 54A is electrically connected to the first shift register 52, and the second latch circuit 55 is electrically connected to the second shift register 53. When the latch signal (LAT) supplied from the printer controller 41 is input to the latch circuits 54, 55, the first latch circuit 54 latches the data of the low order bit (L) of the dot print data (SI), and the second latch circuit 55 latches the data of the high order bit (H) of the dot print data (SI). The sets of the first shift register 52 and the first latch circuit 54, and the second shift register 53 and the second latch circuit 55 which operate as described above constitute storage circuits, respectively to temporarily store the dot print data (SI) prior to the input to the decoder 56.

The driving signals (COMA, COMB) generated by the driving signal generating section 80 will be described. In the embodiment, as shown in FIG. 3, the driving signal generating section 80 has the first driving signal generating circuit 80A and the second driving signal generating circuit 80B.

As shown in FIG. 3, the first driving signal generating circuit 80A is configured by: a memory 81A which stores a driving waveform data that is supplied from the control section 46 in the printer controller 41, and the like; a first latch 82A which temporarily stores the driving waveform data that is read out from the memory 81A, an adder 83A which adds an output of the first latch 82A to an output of a second latch 84A that will be described below; the second latch 84A; a D/A converter 86A which converts the output of the second latch 84A to an analog data; a voltage amplifier circuit 88A which amplifies the converted analog signal to the voltage of the driving signal; and a current amplifier circuit 89A which current-amplifies the driving waveform signal that has been voltage-amplified by the voltage amplifier circuit 88A, to a level at which the analog switches 59A to 59N can be driven, the amplified signal being then output. The memory 81A previously stores predetermined parameters which determine the waveform of the driving signal COMA. As described later, the waveform of the driving signal COMA is determined by predetermined parameters which are previously received from the control section 46, etc.

As shown in FIG. 3, the second driving signal generating circuit 80B is configured by: a memory 81B which stores a driving waveform data that is supplied from the control section 46 in the printer controller 41, and the like; a first latch 82B which temporarily stores the driving waveform data that is read out from the memory 81B; an adder 83B which adds an output of the first latch 82B to an output of a second latch 84B that will be described below; the second latch 84B; a D/A converter 86B which converts the output of the second latch 84B to an analog data; a voltage amplifier circuit 88B which amplifies the convened analog signal to the voltage of the driving signal; and a current amplifier circuit 89B which current-amplifies the driving Waveform signal that has been voltage-amplified by the voltage amplifier circuit 88B, to a level at which the analog switches 59A to 59N can be driven, the amplified signal being then output. The memory 81 B previously stores predetermined parameters which determine the waveform of the driving signal COMB. Also the waveform of the driving signal COMB is determined by predetermined parameters which are previously received from the control section 46, etc., but the parameters are set so as to constitute a waveform different in shape from the waveform of the driving signal COMA. As shown in FIG. 4, outputs of the first and second driving signal generating circuits RCA and 80B are connected to the analog switches 59A to 59N via the internal I/F 49, and the analog switches 59A to 59N are connected to the corresponding piezoelectric vibrators 36A to 36N. In the ejection surface of the print head, plural nozzles (for example, 96 nozzles per row) are formed so as to be positioned in seven rows corresponding to the above-mentioned colors of C, M, Y, K, LC, LM and DY. The piezoelectric vibrators 36A to 36N which are disposed correspondingly with the nozzles are driven to vibrate so as to pressurize the inks in the pressure chambers, whereby ink droplets are ejected from the nozzles, respectively.

The head driving apparatus according to the embodiment is configured in the following manner. In the driving signal generating section 80, the first driving signal generating circuit 80A generates the first driving signal (COMA) including at least the first and second driving pulses, the second driving signal generating circuit 80B generates the second driving signal (COMB) including at least the first and second driving pulses, and, in one print period, the first and second driving pulses of the first driving signal (COMA) and the second driving signal (COMB) are selectively combined with each other and then supplied to the piezoelectric vibrator 36 serving as a driving element.

The first driving signal generating circuit 80A generates a series of the driving signal COMA in which, as shown in FIG. 5, two driving pulses ADP1 and ADP2 for ink droplets of the same amount are arranged in a print period.

The driving signal (COMA) has the first driving pulse ADP1 placed in a term T1 (i.e., generated in the term T1), and the second driving pulse ADP2 placed in a term T2 that follows the term T1, and is repeatedly generated in the print period TA. In the driving signal COMA, the first and second driving pulses ADP1 and ADP2 have the same waveform such as shown in FIG. 5. When the driving pulses are supplied to the piezoelectric vibrator 36, ink droplets of a predetermined amount (for example, about 13 pl and about 13 pl) are ejected from the corresponding nozzle opening of the print head 10. Namely, the first and second driving pulses ADP1 and ADP2 have the same waveform and cause ejection of an ink droplet of a medium amount of about 13 pl. Dots which are obtained by the first and second driving pulses ADP1 and ADP2 have a diameter of a medium degree. Therefore, the first and second driving pulses ADP1 and ADP2 may be referred to as "medium dot pulses".

By contrast, the second driving signal generating circuit 80B generates a series of the driving signal COMB in which, as shown in FIG. 5, two driving pulses BDP1 and BDP2 for ink droplets of different amounts are arranged in a print period.

The driving signal (COMB) has the first driving pulse BDP1 placed in the term T1 (i.e., generated in the term T1), and the second driving pulse BDP2 placed in the term T2 that follows the term T1, and is repeatedly generated in the print period TA. In the driving signal COMB, the first and second driving pulses BDP1 and BDP2 have different waveforms as shown in FIG. 5. The first driving pulse BDP1 causes an ink in the vicinity of a center nozzle hole of each color head to minutely vibrate, thereby preventing the viscosity of the ink from being increased. Ejection of an ink droplet is not caused by the first driving pulse BDP1. The first driving pulse BDP1 may be referred to as "minute-vibration pulse". The second driving pulse BDP2 is formed by a trapezoidal wave which is different from the waveforms of the first and second driving pulses ADP1 and ADP2 of the driving signal COMA, and causes ejection of a small ink droplet of, for example, about 6 pl. A small dot diameter can be obtained by the second driving pulse BDP2, and hence the second driving pulse BDP2 may be referred to as "small-dot pulse".

Figure 6:
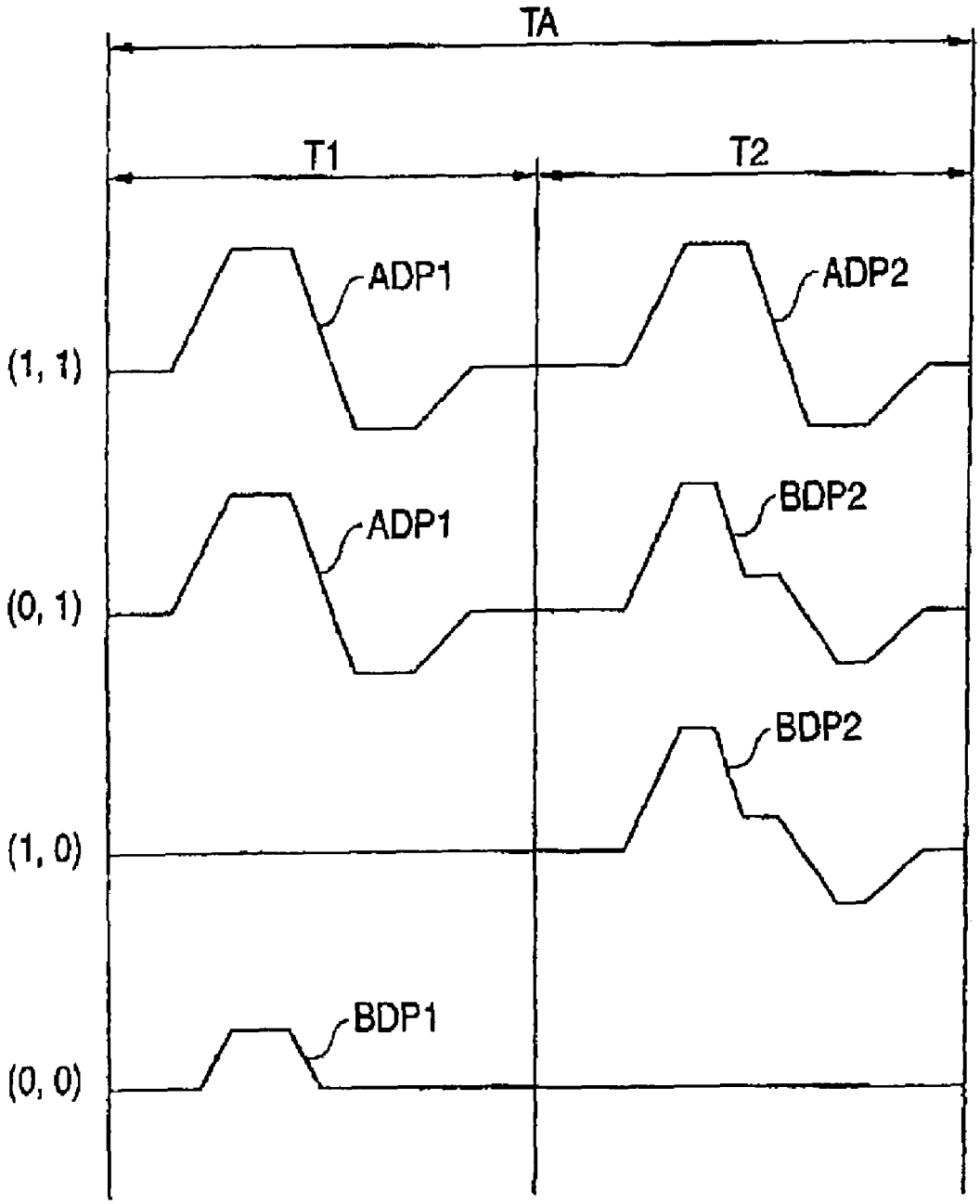
FIG. 6 is a view showing waveforms which are formed by combining wholly or partly the driving signals COMA and COMB to be applied to a transmission gate 59.

Next, the configuration for giving 2-bit pulse selecting information to the transmission gate 59 and the like will be described with reference to FIG. 6. FIG. 6 shows waveforms which are formed by combining wholly or partly the driving signals COMA and COMB to be applied to the transmission gate 59.

First, the 2-bit dot print data (SI) [DH, DL] which is stored in the output buffer 44C, and which is provided for each of the nozzles is serial/parallel converted by the first and second shift registers 52 and 53, and then stored into the first and second latch circuits 54 and 55 to obtain an input data (DH, DL) for the decoder 56. When (DH, DL) is (1, 1), the first driving pulse ADP1 of the driving signal COMA is selected in the first half T1 of the print period, and the second driving pulse ADP2 of the driving signal COMA is selected in the second half T2 of the print period. When (DH, DL) is (0, 1), the first driving pulse ADP1 of the driving signal COMA is selected in the first half T1 of the print period, and the second driving pulse BDP2 of the driving signal COMB is selected in the second half T2 of the print period. When (DH, DL) is (1, 1), both the first driving pulse ADP1 of the driving signal COMA and the first driving pulse BDP1 of the driving signal COMB are not selected in the first half T1 of the print period, and the second driving pulse BDP2 of the driving signal COMB is selected in the second half T2 of the print period. When (DH, DL) is (0, 0), the first driving pulse BDP1 of the driving signal COMB is selected in the first half T1 of the print period, and both the second driving pulse ADP2 of the driving signal COMA and the second driving pulse BDP2 of the driving signal COMB are not selected in the second half T2 of the print period. The dot print data (SI) is transferred to the shift registers 52, 53 in one print period, and latched at the latch circuits 54, 55 by the next latch signal. Namely, the dot print data (SI) which is to be executed in a certain print period is transferred to the print head 10 in the immediately preceding print period.

Then, the transferred dot print data (SI) is supplied as pulse selecting information in accordance with the generation timings of the driving pulses. The generation timings of the driving pulses are detected by the channel signal (CH) and the latch signal (LAT) which are shown in FIG. 5. Specifically, the generation timings of the first driving pulse ADP1 of the driving signal COMA and the first driving pulse BDP1 of the driving signal COMB are detected in accordance with the latch signal (LAT), and those of the second driving pulse ADP2 of the driving signal COMA and the second driving pulse BDP2 of the driving signal COMB are detected in accordance with the channel signal (CH).

Figure 7:
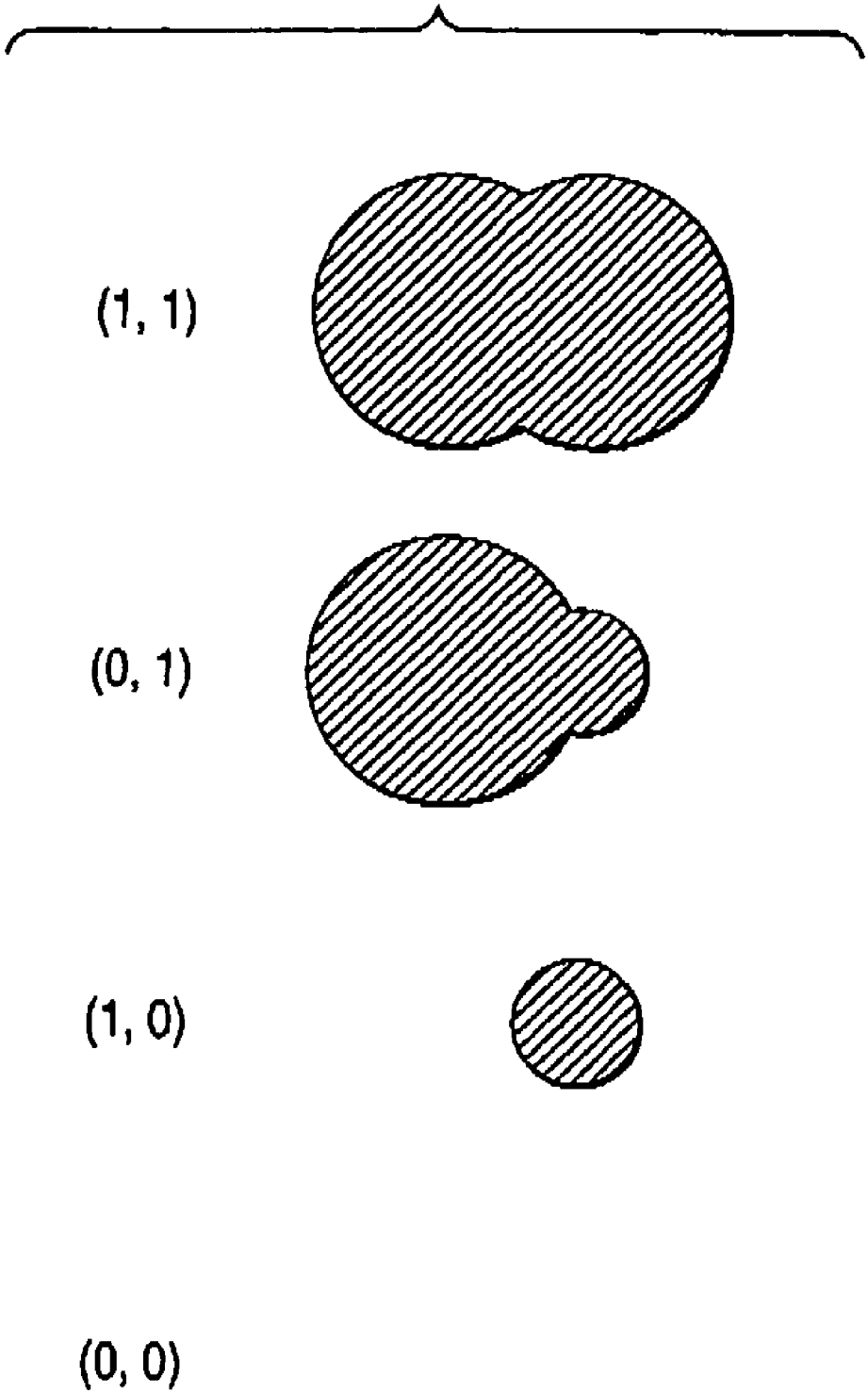
FIG. 7 is a view showing recording dots which are respectively formed on a recording sheet by the driving signals shown in FIG. 6.

FIG. 7 shows recording dots which are respectively formed on a recording sheet by the driving signals shown in FIG. 6, As shown in FIG. 7, when (1, 1) or the first driving pulse ADP1 of the driving signal COMA is selected in the first half T1 of the print period and the second driving pulse ADP2 of the driving signal COMA is selected in the second half T2 of the print period, two ink droplets each corresponding to about 13 pl are ejected, and the ink droplets are impacted onto the recording sheet to unite with each other, whereby a large recording dot is formed. When (0, 1) or the first driving pulse ADP1 of the driving signal COMA is selected in the first half T1 of the print period and the second driving pulse BDP2 of the driving signal COMB is selected in the second half T2 of the print period, an ink droplet corresponding to about 13 pl and that corresponding to about 6 pl are ejected, and the ink droplets are impacted onto the recording sheet to unite with each other, whereby a medium recording dot is formed. When (1, 1) or both the first driving pulse ADP1 of the driving signal COMA and the first driving pulse BDP1 of the driving signal COMB are not selected in the first half T1 of the print period and the second driving pulse BDP2 of the driving signal COMB is selected in the second half T2 of the print period, only an ink droplet corresponding to about 6 pi is ejected, and the ink droplet is impacted onto the recording sheet, whereby a small recording dot is formed. When (0, 0) or the first driving pulse BDP1 of the driving signal COMB is selected in the first half T1 of the print period and both the second driving pulse ADP2 of the driving signal COMA and the second driving pulse BDP2 of the driving signal COMB are not selected in the second half T2 of the print period, only minute vibration of an ink in the vicinity of a nozzle hole is conducted, and an ink droplet is not ejected, so that no dot is formed on the recording sheet.

As described above, the embodiment is configured so that, in an ink jet printer in which the piezoelectric vibrators 36 serving as driving elements that are disposed to respectively correspond to plural nozzles are operated on the basis of an input gray-scale data, thereby ejecting liquid droplets from the nozzles, the first driving signal (COMA) including at least the first and second driving pulses ADP1 and ADP2, and the second driving signal (COMB) including at least the first and second driving pulses BDP1 and BDP2 are generated, and, in one print period, the first and second driving pulses ADP1 and ADP2 of the first driving signal (COMA), and the first and second driving pulses BDP1 and BDP2 of the second driving signal (COMB) are selectively combined with each other in accordance with the gray-scale data, and then supplied to the piezoelectric vibrators 36. Therefore, it is not required to use a large IC for the transmission gate 59 (TG) in the print head, and the print head can be driven with a short ejection period.

In the case where the four-level dot gradation is to be conducted as described above, a program (pattern) data (SP) corresponding to a truth table is input to a combination circuit and the like as described in JP-A-10-81013, so that the combination of the dot print data (gray-scale value) and the driving pulses can be freely set.

Preferred specific examples of the decoder and the control logic

FIRST SPECIFIC EXAMPLE

Figure 8:
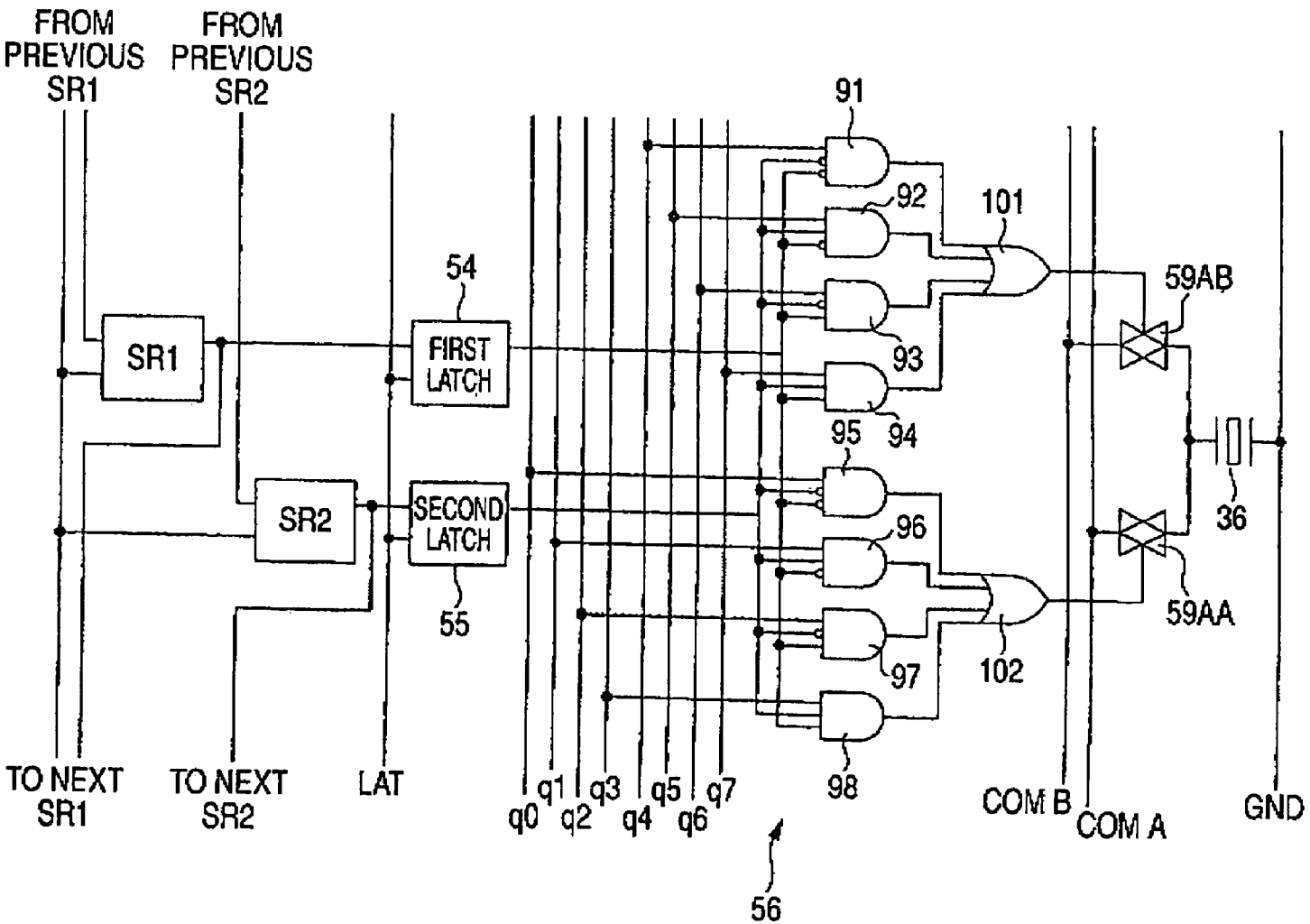
FIG. 8 is a view showing a decoder 56 in a first specific example.

FIG. 8 shows the decoder 56 according to a first specific example. For each of the nozzles, the decoder 56 includes: four AND gates 91 to 94 for COMB; an OR gate 101 for COMB to which outputs of the AND gates 91 to 94 are input; four AND gates 95 to 98 for COMA; and an OR gate 102 for COMA to which outputs of the AND gates 95 to 98 are input. In the case where the number of the nozzles is 96, for example, 96 logic circuits each configured by the AND gates 91 to 98 and the OR gates 101 and 102 are prepared. A data of the low order bit of a gray-scale data is latched at the first latch circuit 54, and that of the high order bit of the gray-scale data is latched at the second latch circuit 55.

Signals output from the first and second latch circuits 54 and 55 are supplied to the AND gates 91 to 98 which respectively correspond to driving pulses.

Figure 9:
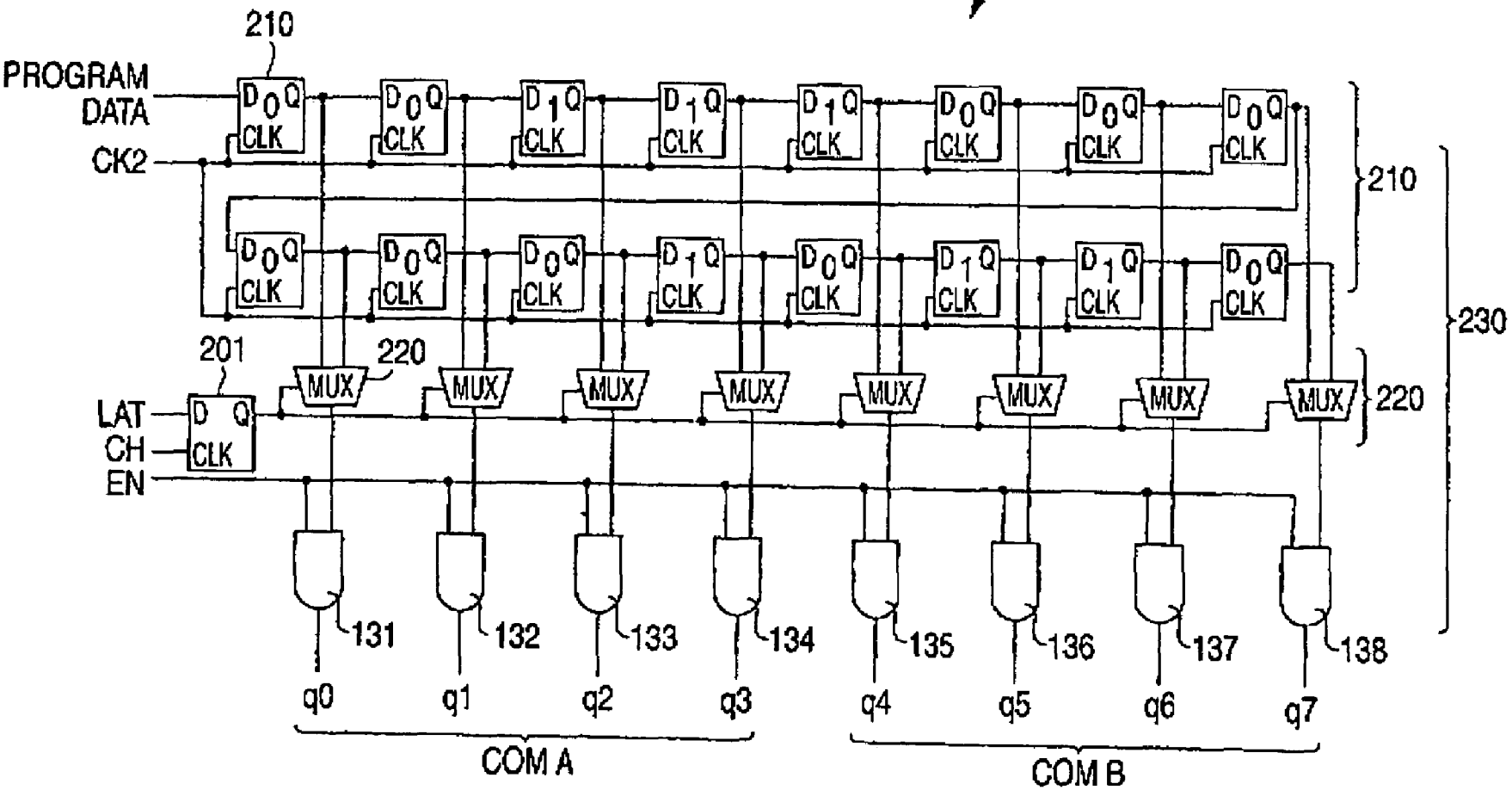
FIG. 9 is a view showing a control logic 57 in the first specific example.

FIG. 9 shows the control logic 57 according to the first specific example. The control logic 57 has: a resettable toggle flip-flop 201; and a logic circuit 230 including plural multiplexers and eight AND gates 131 to 138. The latch signal LAT is input to the reset terminal of the resettable toggle flip-flop 201, and the channel signal CH is input to the CLK terminal. In the logic circuit 230, flip-flops 210 are arranged in two stages in each of which eight flip-flops are connected, and outputs Q of the flip-flops 210 in each stage are connected to the eight multiplexers 220, respectively. An output of the resettable toggle flip-flop 201 is input to the multiplexers 220. In accordance with the output of the resettable toggle flip-flop 201, therefore, each of the multiplexers 220 selects one of the two outputs Q which are input to the multiplexer, and outputs the selected output Q. A program data is previously input to the flip-flops 210 in each stage so as to correspond to outputs of the multiplexers 220 or outputs q0 to q7 of the AND gates 131 to 138. Namely, a data string of the program data is poured into the flip-flop 210 in the left end of the upper stage in accordance with a data transfer clock signal CK2, and then stored into the flip-flops 210 in each stage. When the first inputs of the multiplexers 220 are selected by the output of the resettable toggle flip-flop 201, the multiplexers 220 output the values of the respective first inputs, and hence the data stored by the flip-flops 210 in the first stage is output. When the second inputs of the multiplexers 220 are selected by the output of the resettable toggle flip-flop 201, the multiplexers 220 output the values of the respective second inputs, and hence the data stored by the flip-flops 210 in the second stage is output. The program data is once input after the power supply of the printer is turned on, and before a printing process is conducted. The program data is used for designating selection among the first and second driving pulses of the first driving signal (COMA) and the second driving signal (COMB). Therefore, the combination of the gray-scale value and the driving pulses can be freely set by changing the program data. When the logic section is incorporated into an IC, therefore, the liquid ejection apparatus can cope with several kinds of apparatuses having different pulse patterns. Since the program data can be rewritten during when the apparatus is being operated, the liquid ejection apparatus can be applied also to, for example, a gray-scale printer which is designed so that the driving pulse pattern is changed during operation.

An enable signal EN is input to the eight AND gates 131 to 138. As shown in FIG. 5, the enable signal EN is a signal which is made negative when the waveform is to be switched over. When the waveform is to be switched over, all the analog switches 59AA and 59AB to 59NA and 59NB are turned off. According to the configuration, during the process of switching over the waveform, a situation where the first driving signal (COMA) and the second driving signal (COMB) are applied at the same time to each of the sets of the analog switches 59AA and 59AB to 59NA and 59NB does not occur, and hence the transmission gate 59 (TG) can be prevented from being broken.

The relationships between the gray-scale data (DH, DL) shown in FIGS. 6 and 7 and the program data shown in FIG. 9 will be described. As described above, the data DL of the low order bit of the gray-scale data is latched at the first latch circuit 54 shown in FIG. 8, and the data DH of the high order bit of the gray-scale data is latched at the second latch circuit 55.

An example will be considered in which the program data is set so that, as shown in FIG. 9, the data stored in the flip-flops 210 of the first stage is "00111000" with starting from the left side, and that stored in the flip-flops 210 of the second stage is "00010110" with starting from the left side.

(A) The case Where the Gray-Scale Data (DH, DL) is (1, 1)

The data DL=1 of the low order bit of the gray-scale data is latched at the first latch circuit 54 shown in FIG. 8, and the data DH=1 of the high order bit of the gray-scale data is latched at the second latch circuit 55.

Therefore, "1" of the gray-scale data DH is input to the four AND gates 91 to 94 for COMB so that the data is inverted and input as "0" to an input terminal of the AND gate 91, the data is input as "1" to an input terminal of the AND gate 92, the data is inverted and input as "0" to an input terminal of the AND gate 93, and the data is input as "1" to an input terminal of the AND gate 94. Furthermore, "1" of the gray-scale data DH is input to the four AND gates 95 to 98 for COMA so that the data is inverted and input as "0" to an input terminal of the AND gate 95, the data is input as "1" to an input terminal of the AND gate 96, the data is inverted and input as "0" to an input terminal of the AND gate 97, and the data is input as "1" to an input terminal of the AND gate 98.

By contrast, "1" of the gray-scale data DL is input to the four AND gates 91 to 94 for COMB so that the data is inverted and input as "0" to another input terminal of the AND gate 91, the data is inverted and input as "0" to another input terminal of the AND gate 92, the data is input as "1" to another input terminal of the AND gate 93, and the data is input as "1" to another input terminal of the AND gate 94. Furthermore, "1" of the gray-scale data DL is input to the four AND gates 95 to 98 for COMA so that the data is inverted and input as "0" to another input terminal of the AND gate 951 the data is inverted and input as "0" to another input terminal of the AND gate 96, the data is input as "0" to another input terminal of the AND gate 97, and the data is input as "1" to another input terminal of the AND gate 98.

When the latch signal LAT is input to the reset terminal of the resettable toggle flip-flop 201, the flip-flop outputs Low and the first pulse generation term T1 is started. Then, the multiplexers 220 output the data "00111000" stored in the flip-flops 210 of the first stage. On the other hand, the enable signal EN is input to the eight AND gates 131 to 138. As shown in FIG. 5, the enable signal EN is positive in the first pulse generation term T1. Therefore, the outputs q0 to q7 of the eight AND gates 131 to 138 are 0, 0, 1, 1, 1, 0, 0, and 0, respectively. As shown in FIG. 9, among the outputs q0 to q7 of the eight AND gates 131 to 138, the outputs q0, q1, q2, and q3 correspond to COMA, and the outputs q4, q5, q6, and q7 correspond to COMB. As shown in FIG. 8, namely, the outputs q0, q1, q2, and q3 are input to the four AND gates 95 to 98 for COMA, and the outputs q4, q5, q6, and q7 are input to the four AND gates 91 to 94 for COMB, respectively.

In the four AND gates 95 to 98 for COMA, therefore, the output q0="0", the inverted input "0" of the high order bit data DH which is latched at the second latch circuit 55, and the inverted input "0" of the low order bit data DL which is latched at the first latch circuit 54 are input to the three input terminals of the AND gate 95, respectively. Consequently, (0, 0, 0) is input to the three input terminals of the AND gate 95, with the result that the output of the AND gate 95 is "0". Similarly, the output q1="0", the input "1" of the high order bit data DH which is latched at the second latch circuit 55, and the inverted input "0" of the low order bit data DL which is latched at the first latch circuit 54 are input to the three input terminals of the AND gate 96, respectively. Therefore, (0, 1, 0) is input to the three input terminals of the AND gate 96, with the result that the output of the AND gate 96 is "0". Similarly, the output q2="1", the inverted input "0" of the high order bit data DH which is latched at the second latch circuit 55, and the input "1" of the low order bit data DL which is latched at the first latch circuit 54 are input to the three input terminals of the AND gate 97, respectively. Therefore, (1, 0, 1) is input to the three input terminals of the AND gate 97, with the result that the output of the AND gate 97 is "0". Similarly, the output q3="1", the input "1" of the high order bit data DH which is latched at the second latch circuit 55, and the input "1" of the low order bit data DL which is latched at the first latch circuit 54 are input to the three input terminals of the AND gate 98, respectively. Therefore, (1, 1, 1) is input to the three input terminals of the AND gate 98, with the result that the output of the AND gate 98 is "1". As a result, (0, 0, 0, 1) is input to the four input terminals of the OR gate 102 for COMA, so that the output of the OR gate 102 for COMA is "1". Consequently, the analog switch 59AM is turned on, and the waveform of the driving signal COMA shown in FIG. 5 is applied to the piezoelectric vibrator 36 in the first pulse generation term T1.

By contrast, in the four AND gates 91 to 94 for COMB, the output q4="1", the inverted input "0" of the high order bit data DH which is latched at the second latch circuit 55, and the inverted input "0" of the low order bit data DL which is latched at the first latch circuit 54 are input to the three input terminals of the AND gate 91, respectively. Therefore, (1, 0, 0) is input to the three input terminals of the AND gate 91, with the result that the output of the AND gate 91 is "0". Similarly, the output q5="0", the input "1" of the high order bit data DH which is latched at the second latch circuit 55, and the inverted input "0" of the low order bit data DL which is latched at the first latch circuit 54 are input to the three input terminals of the AND gate 92, respectively. Therefore, (0, 1, 0) is input to the three input terminals of the AND gate 92, with the result that the output of the AND gate 92 is "0". Similarly, the output q6="0", the inverted input "0" of the high order bit data DH which is latched at the second latch circuit 55, and the input "1" of the low order bit data DL which is latched at the first latch circuit 54 are input to the three input terminals of the AND gate 93, respectively. Therefore, (0, 0, 1) is input to the three input terminals of the AND gate 93, with the result that the output of the AND gate 93 is "0". Similarly, the output q7="0", the input "1" of the high order bit data DH which is latched at the second latch circuit 55, and the input "1 " of the low order bit data DL which is latched at the first latch circuit 54 are input to the three input terminals of the AND gate 94, respectively. Therefore, (0, 1, 1) is input to the three input terminals of the AND gate 94, with the result that the output of the AND gate 94 is "0". As a result, (0, 0, 0, 0) is input to the four input terminals of the OR gate 101 for COMB, so that the output of the OR gate 101 for COMB is "0". Consequently, the analog switch 59AB is not turned on, and the waveform of the driving signal COMB shown in FIG. 5 is not applied to the piezoelectric vibrator 36 in the first pulse generation term T1.

When the channel signal CH is input to the CLK terminal of the resettable toggle flip-flop 201, the second pulse generation term T2 is started. Then, the multiplexers 220 output the data "00010110" stored in the flip-flops 210 of the second stage. On the other hand, the enable signal EN is input to the eight AND gates 131 to 138. As shown in FIG. 5, the enable signal EN is positive in the second pulse generation term T2. Therefore, the outputs q0 to q7 of the eight AND gates 131 to 138 are 0, 0, 0, 1, 0, 1, 1, and 0, respectively. As shown in FIG. 8, the outputs q0, q1, q2, and q3 are input to the four AND gates 95 to 98 for COMA, and the outputs q4, q5, q6, and q7 are input to the four AND gates 91 to 94 for COMB, respectively.

As described above, the gray-scale data (DH, DL) shown in FIGS. 6 and 7 is similarly (1, 1), and hence (0, 0, 0) is input to the three input terminals of the AND gate 95. As a result, the output of the AND gate 95 is "0". Furthermore, (0, 1, 0) is input to the three input terminals of the AND gate 96, with the result that the output of the AND gate 96 is "0". Furthermore, (0, 0, 1) is input to the three input terminals of the AND gate 97, with the result that the output of the AND gate 97 is "0". Moreover, (1, 1, 1) is input to the three input terminals of the AND gate 98, with the result that the output of the AND gate 98 is "1". As a result, (0, 0, 0, 1) is input to the four input terminals of the OR gate 102 for COMA, so that the output of the OR gate 102 for COMA is "1". Consequently, the analog switch 59AA is turned on, and the waveform of the driving signal COMA shown in FIG. 5 is applied to the piezoelectric vibrator 36 in the second pulse generation term T2.

By contrast, in the four AND gates 91 to 94 for COMB, (0, 0, 0) is input to the three input terminals of the AND gate 91, with the result that the output of the AND gate 91 is "0". Moreover, (1, 1, 0) is input to the three input terminals of the AND gate 92, with the result that the output of the AND gate 92 is "0". Moreover, (1, 0, 1) is input to the three input terminals of the AND gate 93, with the result that the output of the AND gate 93 is "0". Moreover, (0, 1, 1) is input to the three input terminals of the AND gate 94, with the result that the output of the AND gate 94 is "0". As a result, (0, 0, 0, 0) is input to the four input terminals of the OR gate 101 for COMB, so that the output of the OR gate 101 for COMB is "0". Consequently, the analog switch 59AB is not turned on, and the waveform of the driving signal COMB shown in FIG. 5 is not applied to the piezoelectric vibrator 36 in the second pulse generation term T2.

In the case where the gray-scale data (DH, DL) is (1, 1), as described above, the waveform of the driving signal COMA is selectively applied to the piezoelectric vibrator 36 in the first and second pulse generation terms T1 and T2 as shown in FIG. 6.

(B) The Case Where the Gray-Scale Data (DH, DL) is (0, 1)

The data DL=1 of the low order bit of the gray-scale data is latched at the first latch circuit 54 shown in FIG. 8, and the data DH=0 of the high order bit of the gray-scale data is latched at the second latch circuit 55.

Therefore, "0" of the gray-scale data DH is input to the four AND gates 91 to 94 for COMB so that the data is inverted and input as "1" to the input terminal of the AND gate 91, the data is input as "0" to the input terminal of the AND gate 92, the data is inverted and input as "1" to the input terminal of the AND gate 93, and the data is input as "0" to the input terminal of the AND gate 94. Furthermore, "0" of the gray-scale data DH is input to the four AND gates 95 to 98 for COMA so that the data is inverted and input as "1" to the input terminal of the AND gate 95, the data is input as "0" to the input terminal of the AND gate 96, the data is inverted and input as "1" to the input terminal of the AND gate 97, and the data is input as "0" to the input terminal of the AND gate 98.

By contrast, "1" of the gray-scale data DL is input to the four AND gates 91 to 94 for COMB so that the data is inverted and input as "0" to the other input terminal of the AND gate 91, the data is inverted and input as "0" to the other input terminal of the AND gate 92, the data is input as "1" to the other input terminal of the AND gate 93, and the data is input as "1" to the other input terminal of the AND gate 94. Furthermore, "1" of the gray-scale data DL is input to the four AND gates 95 to 98 for COMA so that the data is inverted and input as "0" to the other input terminal of the AND gate 95, the data is inverted and input as "0" to the other input terminal of the AND gate 96, the data is input as "1" to the other input terminal of the AND gate 97, and the data is input as "1" to the other input terminal of the AND gate 98.

When the latch signal LAT is input to the reset terminal of the resettable toggle flip-flop. 201, the first pulse generation term T1 is started. Then, the multiplexers 220 output the data "00111000" stored in the flip-lops 210 of the first stage. On the other hand, the enable signal EN is input to the eight AND gates 131 to 138. As shown in FIG. 5, the enable signal EN is positive in the first pulse generation term T1. Therefore, the outputs q0 to q7 of the eight AND gates 131 to 138 are 0, 0, 1, 1, 1, 0, 0, and 0, respectively. As shown in FIG. 9, among the outputs q0 to q7 of the eight AND gates 131 to 138, the outputs q0, q1, q2, and q3 correspond to COMA, and the outputs q4, q5, q6, and q7 correspond to COMB. As shown in FIG. 8, namely, the outputs q0, q1, q2, and q3 are input to the four AND gates 95 to 98 for COMA, and the outputs q4, q5, q6, and q7 are input to the four AND gates 91 to 94 for COMB, respectively.

The data (0, 1, 0) is input to the three input terminals of the AND gate 96, with the result that the output of the AND gate 95 is "0". Moreover, (0, 0, 0) is input to the three input terminals of the AND gate 96, with the result that the output of the AND gate 96 is "0". Moreover, (1, 1, 1) is input to the three input terminals of the AND gate 97, with the result that the output of the AND gate 97 is "1". Moreover, (1, 0, 1) is input to the three input terminals of the AND gate 98, with the result that the output of the AND gate 98 is "0". As a result, (0, 0, 1, 0) is input to the four input terminals of the OR gate 102 for COMA, so that the output of the OR gate 102 for COMA is "1". Consequently, the analog switch 59M is turned on, and the waveform of the driving signal COMA shown in FIG. 5 is applied to the piezoelectric vibrator 36 in the first pulse generation term T1.

By contrast, in the four AND gates 91 to 94 for COMB, (1, 1, 0) is input to the three input terminals of the AND gate 91, with the result that the output of the AND gate 91 is "0". Moreover, (0, 0, 0) is input to the three input terminals of the AND gate 92, with the result that the output of the AND gate 92 is "0". Moreover, (0, 1, 1) is input to the three input terminals of the AND gate 93, with the result that the output of the AND gate 93 is "0". Moreover, (0, 0, 1) is input to the three input terminals of the AND gate 94, with the result that the output of the AND gate 94 is "0". As a result, (0, 0, 0, 0) is input to the four input terminals of the OR gate 101 for COMB, so that the output of the OR gate 101 for COMB is "0". Consequently, the analog switch 59AB is not turned on, and the waveform of the driving signal COMB shown in FIG. 5 is not applied to the piezoelectric vibrator 36 in the first pulse generation term T1.

When the channel signal CH is input to the CLK terminal of the resettable toggle flip-flop 201, the second pulse generation term T2 is started. Then, the multiplexers 220 output the data "00010110" stored in the flip-flops 210 of the second stage. On the other hand, the enable signal EN is input to the eight AND gates 131 to 138. As shown in FIG. 5, the enable signal EN is positive in the second pulse generation term T2. Therefore, the outputs q0 to q7 of the eight AND gates 131 to 138 are 0, 0, 0, 1, 0, 1, 1, and 0, respectively. As shown in FIG. 8, the outputs q0, q1, q2, and q3 are input to the four AND gates 95 to 98 for COMA, and the outputs q4, q5, q6, and q7 are input to the four AND gates 91 to 94 for COMB, respectively.

As described above, the gray-scale data (DH, DL) shown in FIGS. 6 and 7 is similarly (0, 1), and hence (0, 1, 0) is input to the three input terminals of the AND gate 95. As a result, the output of the AND gate 95 is "0". Furthermore, (0, 0, 0) is input to the three input terminals of the AND gate 96, with the result that the output of the AND gate 96 is "0". Furthermore, (0, 1, 1) is input to the three input terminals of the AND gate 97, with the result that the output of the AND gate 97 is "0". Moreover, (1, 0, 1) is input to the three input terminals of the AND gate 98, with the result that the output of the AND gate 98 is "0". As a result, (0, 0, 0, 0) is input to the four input terminals of the OR gate 102 for COMA, so that the output of the OR gate 102 for COMA is "0". Consequently, the analog switch 59M is not turned on, and the waveform of the driving signal COMA shown in FIG. 5 is not applied to the piezoelectric vibrator 36 in the second pulse generation term T2.

By contrast, in the four AND gates 91 to 94 for COMB, (0, 1, 0) is input to the three input terminals of the AND gate 91, with the result that the output of the AND gate 91 is "0". Moreover, (1, 0, 0) is input to the three input terminals of the AND gate 92, with the result that the output of the AND gate 92 is "0". Moreover, (1, 1, 1) is input to the three input terminals of the AND gate 93, with the result that the output of the AND gate 93 is "1". Moreover, (0, 0, 1) is input to the three input terminals of the AND gate 94, with the result that the output of the AND gate 94 is "0". As a result, (0, 0, 1, 0) is input to the four input terminals of the OR gate 101 for COMB, so that the output of the OR gate 101 for COMB is "1". Consequently, the analog switch 59AB is turned on, and the waveform of the driving signal COMB shown in FIG. 5 is applied to the piezoelectric vibrator 36 in the second pulse generation term T2.

In the case where the gray-scale data (DH, DL) is (0, 1), as described above, the waveform of the driving signal COMA is selectively applied to the piezoelectric vibrator 36 in the first pulse generation term T1 as shown in FIG. 6, and that of the driving signal COMB is selectively applied to the piezoelectric vibrator 36 in the second pulse generation term T2 as shown in FIG. 6.

(C) The Case Where the Gray-Scale Data (DH, DL) is (1, 1)

The data DL=0 of the low order bit of the gray-scale data is latched at the first latch circuit 54 shown in FIG. 8, and the data DH=1 of the high order bit of the gray-scale data is latched at the second latch circuit 55.

Therefore, "1" of the gray-scale data DH is input to the four AND gates 91 to 94 for COMB so that the data is inverted and input as "0" to the input terminal of the AND gate 91, the data is input as "1" to the input terminal of the AND gate 92, the data is inverted and input as "0" to the input terminal of the AND gate 93, and the data is input as "1" to the input terminal of the AND gate 94. Furthermore, "1" of the gray-scale data DH is input to the four AND gates 95 to 98 for COMA so that the data is inverted and input as "0" to the input terminal of the AND gate 95, the data is input as "1" to the input terminal of the AND gate 96, the data is inverted and input as "0" to the input terminal of the AND gate 97, and the data is input as "1" to the input terminal of the AND gate 98.

By contrast, "0" of the gray-scale data DL is input to the four AND gates 91 to 94 for COMB so that the data is inverted and input as "1" to the other input terminal of the AND gate 91, the data is inverted and input as "1" to the other input terminal of the AND gate 92, the data is input as "0" to the other input terminal of the AND gate 93, and the data is input as "0" to the other input terminal of the AND gate 94. Furthermore, "0" of the gray-scale data DL is input to the four AND gates 95 to 98 for COMA so that the data is inverted and input as "1" to the other input terminal of the AND gate 95, the data is inverted and input as "1" to the other input terminal of the AND gate 96, the data is input as "0" to the other input terminal of the AND gate 97, and the data is input as "0" to the other input terminal of the AND gate 98.

When the latch signal LAT is input to the reset terminal of the resettable toggle flip-flop 201, the first pulse generation term T1 is started. Then, the multiplexers 220 output the data "00111000" stored in the flip-flops 210 of the first stage.

On the other hand, the enable signal EN is input to the eight AND gates 131 to 138. As shown in FIG. 5, the enable signal EN is positive in the first pulse generation term T1. Therefore, the outputs q0 to q7 of the eight AND gates 131 to 138 are 0, 0, 1, 1, 1, 0, 0, and 0, respectively. As shown in FIG. 9, among the outputs q0 to q7 of the eight AND gates 131 to 138, the outputs q0, q1, q2, and q3 correspond to COMA, and the outputs q4, q5, q6, and q7 correspond to COMB. As shown in FIG. 8, namely, the outputs q0, q1, q2, and q3 are input to the four AND gates 95 to 98 for COMA, and the outputs q4, q5, q6, and q7 are input to the four AND gates 91 to 94 for COMB, respectively.

The data (0, 0, 1) is input to the three input terminals of the AND gate 95, with the result that the output of the AND gate 95 is "0". Moreover, (0, 1, 1) is input to the three input terminals of the AND gate 96, with the result that the output of the AND gate 96 is "0". Moreover, (1, 0, 0) is input to the three input terminals of the AND gate 97, with the result that the output of the AND gate 97 is "0". Moreover, (1, 1, 0) is input to the three input terminals of the AND gate 98, with the result that the output of the AND gate 98 is "0". As a result, (0, 0, 0, 0) is input to the four input terminals of the OR gate 102 for COMA, so that the output of the OR gate 102 for COMA is "0". Consequently, the analog switch 59AA is not turned on, and the waveform of the driving signal COMA shown in FIG. 5 is not applied to the piezoelectric vibrator 36 in the first pulse generation term T1.

By contrast, in the four AND gates 91 to 94 for COMB, (1, 0, 1) is input to the three input terminals of the AND gate 91, with the result that the output of the AND gate 91 is "0". Moreover, (0, 1, 1) is input to the three input terminals of the AND gate 92, with the result that the output of the AND gate 92 is "0". Moreover, (0, 0, 0) is input to the three input terminals of the AND gate 93, with the result that the output of the AND gate 93 is "0". Moreover, (0, 1, 0) is input to the three input terminals of the AND gate 94, with the result that the output of the AND gate 94 is "0". As a result, (0, 0, 0, 0) is input to the four input terminals of the OR gate 101 for COMB, so that the output of the OR gate 101 for COMB is "0". Consequently, the analog switch 59AB is not turned on, and the waveform of the driving signal COMB shown in FIG. 5 is not applied to the piezoelectric vibrator 36 in the first pulse generation term T1.

When the channel signal CH is input to the CLK terminal of the resettable toggle flip-flop 201, the second pulse generation term T2 is started. Then, the multiplexers 220 output the data "00010110" stored in the flip-flops 210 of the second stage. On the other hand, the enable signal EN is input to the eight AND gates 131 to 138. As shown in FIG. 5, the enable signal EN is positive in the second pulse generation term T2. Therefore, the outputs q0 to q7 of the eight AND gates 131 to 138 are 0, 0, 0, 1, 0, 1, 1, and 0, respectively. As shown in FIG. 8, the outputs q0, q1, q2, and q3 are input to the four AND gates 95 to 98 for COMA, and the outputs q4, q5, q6, and q7 are input to the four AND gates 91 to 94 for COMB, respectively.

As described above, the gray-scale data (DH, DL) shown in FIGS. 6 and 7 is similarly (1, 1), and hence (0, 0, 1) is input to the three input terminals of the AND gate 95. As a result, the output of the AND gate 95 is "0". Furthermore, (0, 1, 1) is input to the three input terminals of the AND gate 96, with the result that the output of the AND gate 96 is "0". Furthermore, (0, 0, 0) is input to the three input terminals of the AND gate 97, with the result that the output of the AND gate 97 is "0". Moreover, (1, 1, 0) is input to the three input terminals of the AND gate 98, with the result that the output of the AND gate 98 is "0". As a result, (0, 0, 0, 0) is input to the four input terminals of the OR gate 102 for COMA, so that the output of the OR gate 102 for COMA is "0". Consequently, the analog switch 59M is not turned on, and the waveform of the driving signal COMA shown in FIG. 5 is not applied to the piezoelectric vibrator 36 in the second pulse generation term T2.

By contrast, in the four AND gates 91 to 94 for COMB, (0, 0, 1) is input to the three input terminals of the AND gate 91, with the result that the output of the AND gate 91 is "0". Moreover, (1, 1, 1) is input to the three input terminals of the AND gate 92, with the result that the output of the AND gate 92 is "1". Moreover, (1, 0, 0) is input to the three input terminals of the AND gate 93, with the result that the output of the AND gate 93 is "0". Moreover, (0, 1, 0) is input to the three input terminals of the AND gate 94, with the result that the output of the AND gate 94 is "0". As a result, (0, 1, 0, 0) is input to the four input terminals of the OR gate 101 for COMB, so that the output of the OR gate 101 for COMB is "1". Consequently, the analog switch 59AB is turned on, and the waveform of the driving signal COMB shown in FIG. 5 is applied to the piezoelectric vibrator 36 in the second pulse generation term T2.

In the case where the gray-scale data (DH, DL) is (1, 1), as described above, the waveforms of both the driving signals COMA and COMB are not selected in the first pulse generation term T1 as shown in FIG. 6, and hence the waveforms of both the driving signals COMA and COMB are not applied to the piezoelectric vibrator 36. In the second pulse generation term T2, the waveform of the driving signal COMB is selectively applied to the piezoelectric vibrator 36 as shown in FIG. 6.

(D) The Case Where the Gray-Scale Data (DH, DL) is (0, 0)

The data DL=0 of the low order bit of the gray-scale data is latched at the first latch circuit 54 shown in FIG. 8, and the data DH=0 of the high order bit of the gray-scale data is latched at the second latch circuit 55.

Therefore, "0" of the gray-scale data DH is input to the four AND gates 91 to 94 for COMB so that the data is inverted and input as "1" to the input terminal of the AND gate 91, the data is input as "0" to the input terminal of the AND gate 92, the data is inverted and input as "1" to the input terminal of the AND gate 93, and the data is input as "0" to the input terminal of the AND gate 94. Furthermore, "0" of the gray-scale data DH is input to the four AND gates 95 to 98 for COMA so that the data is inverted and input as "1" to the input terminal of the AND gate 95, the data is input as "0" to the input terminal of the AND gate 96, the data is inverted and input as "1" to the input terminal of the AND gate 97, and the data is input as "0" to the input terminal of the AND gate 98.

By contrast, "0" of the gray-scale data DL is input to the four AND gates 91 to 94 for COMB so that the data is inverted and input as "1" to the other input terminal of the AND gate 91, the data is inverted and input as "1" to the other input terminal of the AND gate 92, the data is input as "0" to the other input terminal of the AND gate 93, and the data is input as "0" to the other input terminal of the AND gate 94. Furthermore, "0" of the gray-scale data DL is input to the four AND gates 95 to 98 for COMA so that the data is inverted and input as "1" to the other input terminal of the AND gate 95, the data is inverted and input as "1" to the other input terminal of the AND gate 96, the data is input as "0" to the other input terminal of the AND gate 97, and the data is input as "0" to the other input terminal of the AND gate 98.

When the latch signal LAT is input to the reset terminal of the resettable toggle flip-flop 201, the first pulse generation term T1 is started. Then, the multiplexers 220 output the data "00111000" stored in the flip-flops 210 of the first stage. On the other hand, the enable signal EN is input to the eight AND gates 131 to 138. As shown in FIG. 5, the enable signal EN is positive in the first pulse generation term T1. Therefore, the outputs q0 to q7 of the eight AND gates 131 to 138 are 0, 0, 1, 1, 1, 0, 0, and 0, respectively. As shown in FIG. 9, among the outputs q0 to q7 of the eight AND gates 131 to 138, the outputs q0, q1, q2, and q3 correspond to COMA, and the outputs q4, q5, q6, and q7 correspond to COMB. As shown in FIG. 8, namely, the outputs q0, q1, q2, and q3 are input to the four AND gates 95 to 98 for COMA, and the outputs q4, q5, q6, and q7 are input to the four AND gates 91 to 94 for COMB, respectively.

The data (0, 1, 1) is input to the three input terminals of the AND gate 95, with the result that the output of the AND gate 95 is "0". Moreover, (0, 1, 1) is input to the three input terminals of the AND gate 96, with the result that the output of the AND gate 96 is "0". Moreover, (1, 1, 0) is input to the three input terminals of the AND gate 97, with the result that the output of the AND gate 97 is "0". Moreover, (1, 0, 0) is input to the three input terminals of the AND gate 98, with the result that the output of the AND gate 98 is "0". As a result, (0, 0, 0, 0) is input to the four input terminals of the OR gate 102 for COMA, so that the output of the OR gate 102 for COMA is "0". Consequently, the analog switch 59AA is not turned on, and the waveform of the driving signal COMA shown in FIG. 5 is not applied to the piezoelectric vibrator 36 in the first pulse generation term T1.

By contrast, in the four AND gates 91 to 94 for COMB, (1, 1, 1) is input to the three input terminals of the AND gate 91, with the result that the output of the AND gate 91 is "1". Moreover, (0, 0, 1) is input to the three input terminals of--the AND gate 92, with the result that the output of the AND gate 92 is "0". Moreover, (0, 1, 0) is input to the three input terminals of the AND gate 93, with the result that the output of the AND gate 93 is "0". Moreover, (0, 0, 0) is input to the three input terminals of the AND gate 94, with the result that the output of the AND gate 94 is "0". As a result, (1, 0, 0, 0) is input to the four input terminals of the OR gate 101 for COMB, so that the output of the OR gate 101 for COMB is "1". Consequently, the analog switch 59AB is turned on, and the waveform of the driving signal COMB shown in FIG. 5 is applied to the piezoelectric vibrator 36 in the first pulse generation term T1.

When the channel signal CH is input to the CLK terminal of the resettable toggle flip-flop 201, the second pulse generation term T2 is started. Then, the multiplexers 220 output the data "00010110" stored in the flip-flops 210 of the second stage. On the other hand, the enable signal EN is input to the eight AND gates 131 to 138. As shown in FIG. 5, the enable signal EN is positive in the second pulse generation term T2. Therefore, the outputs q0 to q7 of the eight AND gates 131 to 138 are 0, 0, 0, 1, 0, 1, 1, and 0, respectively. As shown in FIG. 8, the outputs q0, q1, q2, and q3 are input to the four AND gates 95 to 98 for COMA, and the outputs q4, q5, q6, and q7 are input to the four AND gates 91 to 94 for COMB, respectively.

As described above, the gray-scale data (DH, DL) shown in FIGS. 6 and 7 is similarly (1, 1), and hence (0, 1, 1) is input to the three input terminals of the AND gate 95. As a result, the output of the AND gate 95 is "0". Furthermore, (0, 0, 1) is input to the three input terminals of the AND gate 96, with the result that the output of the AND gate 96 is "0". Furthermore, (0, 1, 0) is input to the three input terminals of the AND gate 97, with the result that the output of the AND gate 97 is "0". Moreover, (1, 0, 0) is input to the three input terminals of the AND gate 98, with the result that the output of the AND gate 98 is "0". As a result, (0, 0, 0, 0) is input to the four input terminals of the OR gate 102 for COMA, so that the output of the OR gate 102 for COMA is "0". Consequently, the analog switch 59AA is not turned on, and the waveform of the driving signal COMA shown in FIG. 5 is not applied to the piezoelectric vibrator 36 in the second pulse generation term T2.

By contrast, in the four AND gates 91 to 94 for COMB, (0, 1, 1) is input to the three input terminals of the AND gate 91, with the result that the output of the AND gate 91 is "0". Moreover, (1, 0, 1) is input to the three input terminals of the AND gate 92, with the result that the output of the AND gate 92 is "0". Moreover, (1, 1, 0) is input to the three input terminals of the AND gate 93, with the result that the output of the AND gate 93 is "0". Moreover, (0, 0, 0) is input to the three input terminals of the AND gate 94, with the result that the output of the AND gate 94 is "0". As a result, (0, 0, 0, 0) is input to the four input terminals of the OR gate 101 for COMB, so that the output of the OR gate 101 for COMB is "0". Consequently, the analog switch 59AB is not turned on, and the waveform of the driving signal COMB shown in FIG. 5 is not applied to the piezoelectric vibrator 36 in the second pulse generation term T2.

In the case where the gray-scale data (DH, DL) is (0, 0), as described above, the waveform of the driving signal COMB is selected and applied to the piezoelectric vibrator 36 in the first pulse generation term T1 as shown in FIG. 6. In the second pulse generation term T2, the waveforms of both the driving signals COMA and COMB are not selected as shown in FIG. 6, and hence the waveforms of both the driving signals COMA and COMB are not applied to the piezoelectric vibrator 36.

SECOND SPECIFIC EXAMPLE

Figure 10:
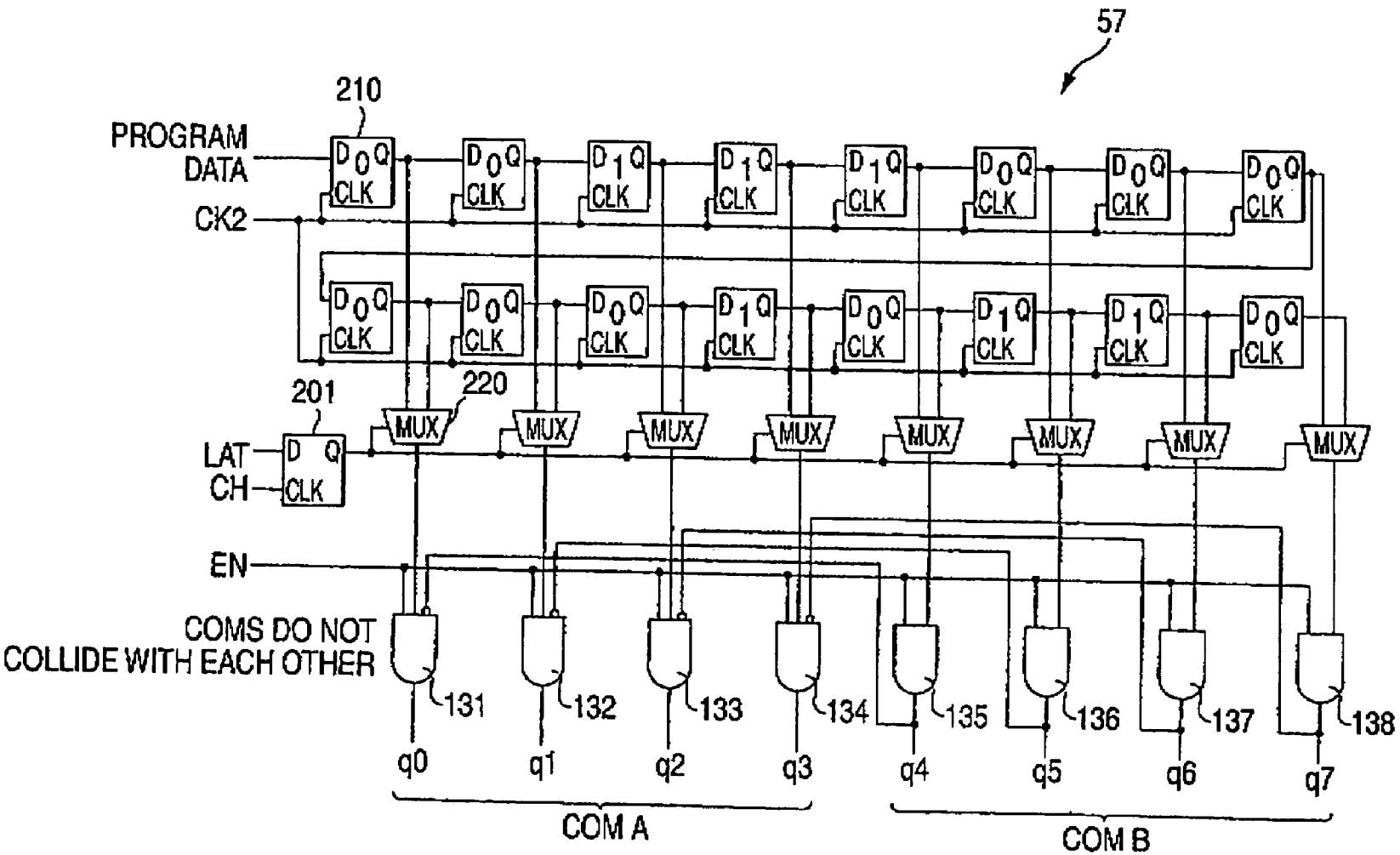
FIG. 10 is a view showing a control logic 57 in a second specific example.

FIG. 10 shows the control logic 57 in a second specific example. In the control logic 57, in order to prevent the driving signals COMA and COMB from colliding with each other, the outputs q4 to q7 of the AND gates 135 to 138 are connected to the AND gates 131 to 134 so as to be input thereinto while being inverted. Namely, the control logic is configured so that, when the outputs q4 to q7 are "1", for example, the outputs q0 to q3 are always "0". This configuration is employed in order to eliminate the possibility that both COMA and COMB are input as, for example, "1" to the analog switches 59AA and 59AB of the transmission gate 59, the outputs of the driving circuits for COMA and COMB collide with each other, and a large current flows through the driving circuits to break the driving circuits.

This configuration will be described with taking the program data used in the description of the first specific example, as an example. The program data used in the description of the first specific example is set so that, as shown in FIG. 9, the data stored in the flip-flops 210 of the first stage is "00111000" with starting from the left side, and that stored in the flip-flops 210 of the second stage is "00010110" with starting from the left side. As described above, the program data is serially transferred from the printer controller 41 to the print head 10, and then input to the flip-flops 210 shown in FIG. 9. It is assumed that noises are produced during the process of the serial transfer to the print head 10 and the left end bit of the data which is to be stored in the flip-flops 210 of the first stage is changed from "0" to "1".

In the control logic 57 in the first specific example shown in FIG. 9, when such an error occurs in the transferred program data, a data "10111000" in the program data is stored into the flip-flops 210 of the first stage. For example, above-described case (D) where the gray-scale data (DH, DL) is (0, 0) will be considered. When the latch signal LAT is input to the reset terminal of the resettable toggle flip-flop 201, the first pulse generation term T1 is started. Then, the multiplexers 220 output the data "10111000" stored in the flip-flops 21 0 of the first stage The output q0 of the AND gate 131 is changed to 1. In the four AND gates 95 to 98 for COMA, therefore, (1, 1, 1) is input to the three input terminals of the AND gate 95, with the result that the output of the AND gate 95 is "1". As a result, the output of the OR gate 102 for COMA is "1", so that the analog switch 59M is turned on. If the other data bits are not changed, the output of the OR gate 101 for COMB is "1" in the first pulse generation term T1 as described above, and also the analog switch 59AB is turned on. If no countermeasure is taken, there occurs a situation where the analog switches 59M and 59AB are turned on at the same time, thereby causing the possibility that the driving circuits are broken.

By contrast, in the control logic 57 according to the present specific example shown in FIG. 10, the outputs q4 to q7 of the AND gates 135 to 138 are connected to the AND gates 131 to 134 so as to be input thereinto while being inverted. As shown in FIG. 10, the above-mentioned program data is stored in the flip-flops 210 of the first stage so as to be "10111000" with starting from the left side. Since the output q4 is "1", the output q4 is inverted and input as "0" to the AND gate 131. Irrespective of the transmission error of the program data, therefore, the output q0 of the AND gate 131 is "0". Consequently, (0, 1, 1) is input to the three input terminals of the AND gate 95, so that the output of the AND-gate 95 is "0". As a result, the output of the OR gate 102 for COMA is "0", and hence the analog switch 59M is never turned on.

As described above, in the control logic 57 in the present specific example, the outputs q4 to q7 of the AND gates 135 to 138 are connected to the AND gates 131 to 134 so as to be input thereinto while being inverted. Namely, the control logic is configured so that, when the outputs q4 to q7 are "1", for example, the outputs q0 to q3 are always "0" Therefore, COMA and COMB are not input at the same time as, for example, "1" to the analog switches 59M and 59AB of the transmission gate 59. In other words, COMA and COMB do not collide with each other, and therefore the possibility that the analog switches 59M and 59AB are broken can be eliminated. It is a matter of course that the program data is configured so that COMA and COMB are not input at the same time as, for example, "1" to the analog switches 59AA and 59AB of the transmission gate 59. Even when noises of some kind are applied to the program data and an error occurs in the transferred program data, the error can be eliminated by circuit processing.

As described above, the embodiment includes a logic circuit constituting a logic in which the plural analog switches 59AA and 59AB are not turned on at the same time during a process of driving the piezoelectric vibrator 36 serving as a driving element. According to the configuration, it is possible to prevent the first driving signal (COMA) and the second driving signal COMB from colliding with each other. Even when noises of some kind are applied to the driving pulses during a transfer process and an error occurs in a transferred data, therefore, the driving circuits can be prevented from being broken.

THIRD SPECIFIC EXAMPLE

Figure 11:
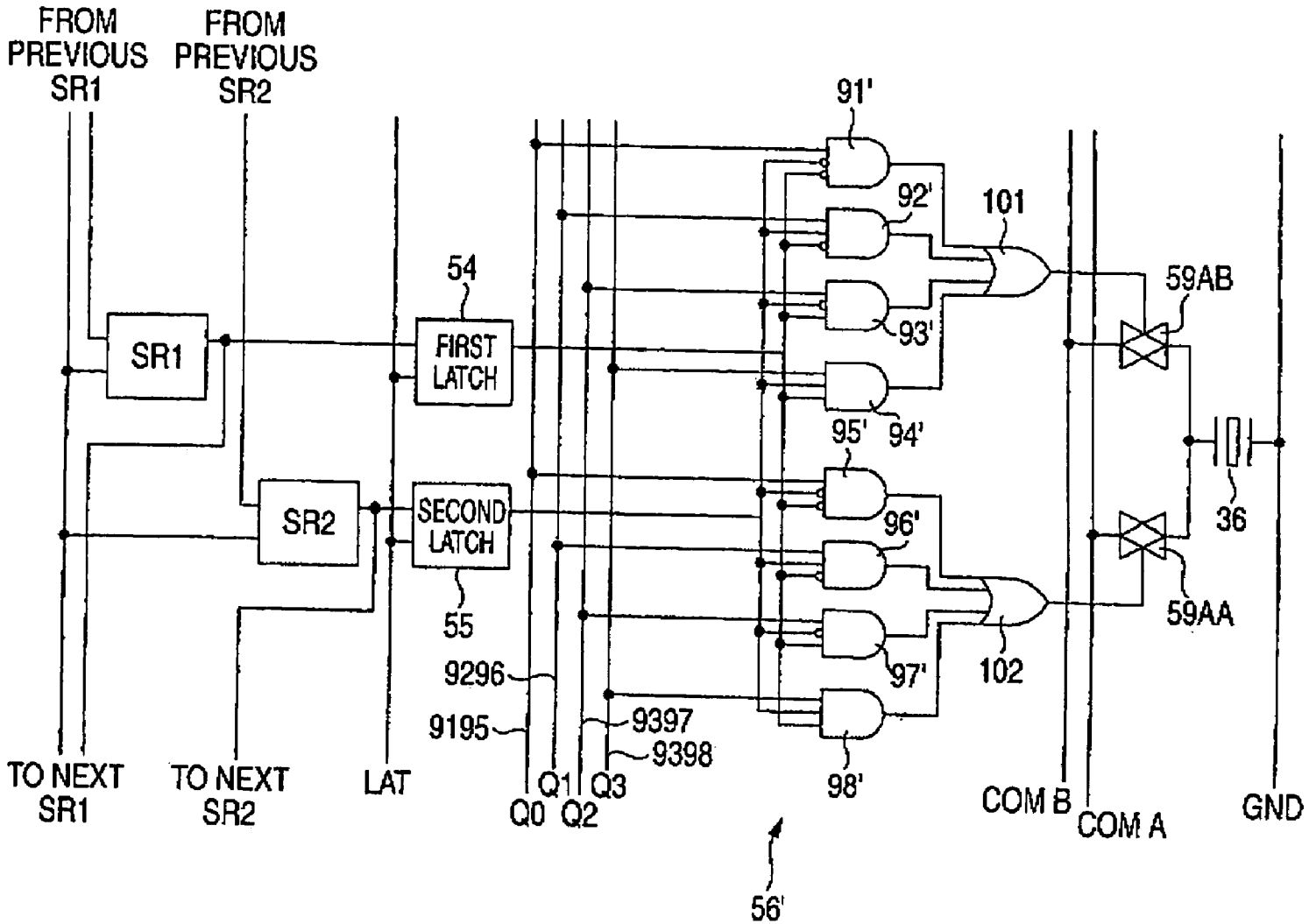
FIG. 11 is a view showing a decoder 56' in a third specific example.
Figure 12:
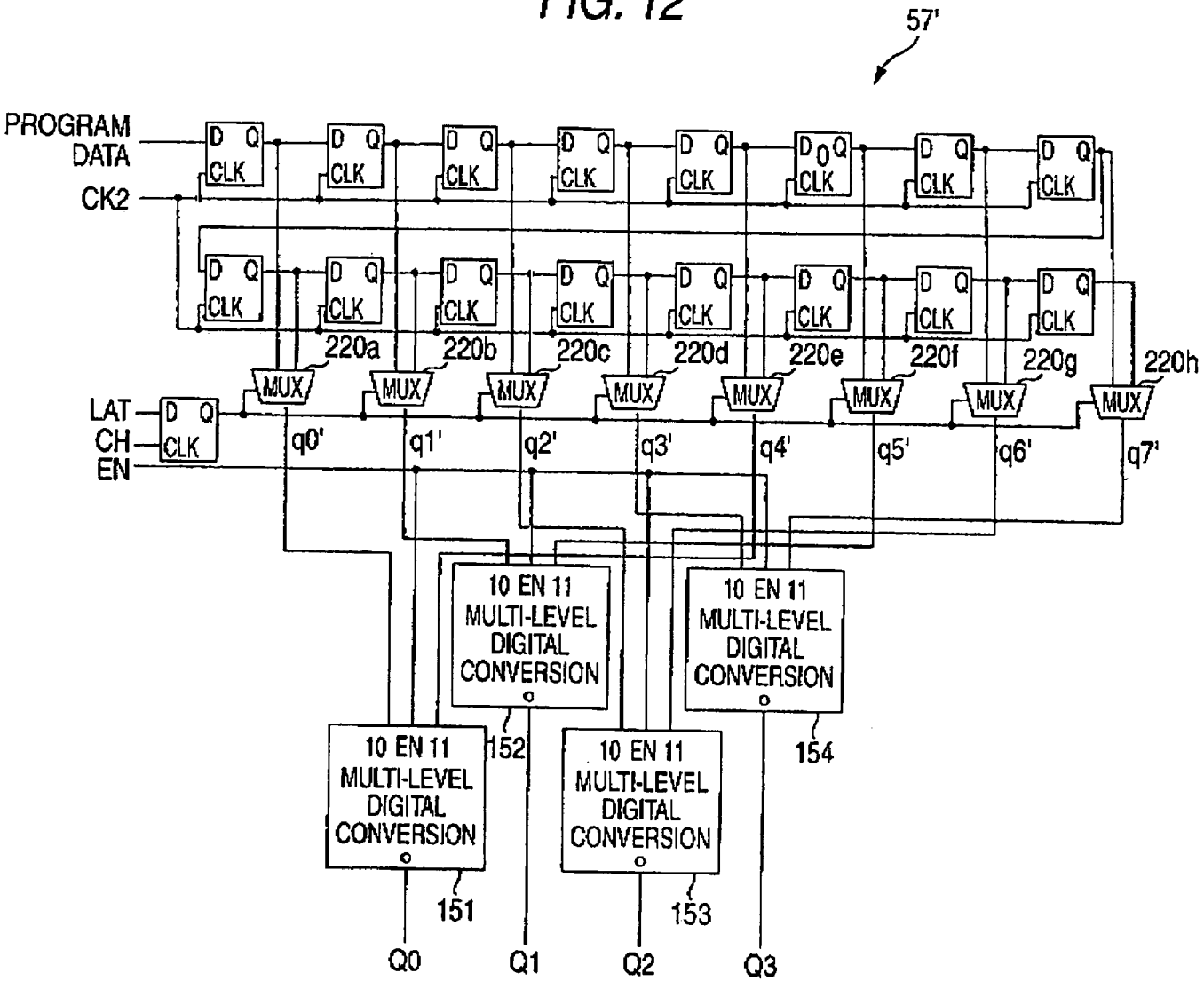
FIG. 12 is a view showing a control logic 57' in the third specific example.

A third specific example is characterized in that the signal indicating which of COMA and COMB is to be selected is not a binary digital signal but a multi-level digital signal. FIG. 11 shows a decoder 56' in the third specific example, and FIG. 12 shows a control logic 57' in the third specific example. The decoder 56' and the control logic 57' are basically configured in a substantially same manner as the decoder 56 and the control logic 57 shown in FIG. 8. In FIG. 11, the components identical with those of FIG. 8 are denoted by the same reference numerals, and their description is omitted.

In the decoder 56' shown in FIG. 11, each of AND gates 91' to 94' for COMB and AND gates 95 to 98' for COMA is configured by an AND gate which can cope with a multi-level digital signal. The AND gate 91' for COMB and the AND gate 95' for COMA are connected to a common input signal line 9195, the AND gate 92' for COMB and the AND gate 96' for COMA are connected to a common input signal line 9296, the AND gate 93' for COMB and the AND gate 97' for COMA are connected to a common input signal line 9397, and the AND gate 94' for COMB and the AND gate 98' for COMA are connected to a common input signal line 9498.

As shown in FIG. 12, the control logic 57' has multi-level digital converters 151 to 154 in place of the AND gates 131 to 138 in the first specific example. An output q0' of a multiplexer 220*a*, an output q4' of a multiplexer 220*e*, and the enable signal EN are input to the multi-level digital converter 151. An output q1' of a multiplexer 220*b*, an output q5' of a multiplexer 220*f*, and the enable signal EN are input to the multi-level digital converter 152. An output q2' of a multiplexer 220*c*, an output q6' of a multiplexer 220*g*, and the enable signal EN are input to the multi-level digital converter 153. An output q3' of a multiplexer 220*d*, an output q7' of a multiplexer 220*h*, and the enable signal EN are input to the multi-level digital converter 154. An output Q0 of the multi-level digital converter 151 is input to the AND gate 91' for COMB and the AND gate 95' for COMA via the input signal line 9195. An output Q1 of the multi-level digital converter 152 is input to the AND gate 92' for COMB and the AND gate 96' for COMA via the input signal line 9296. An output Q2 of the multi-level digital converter 153 is input to the AND gate 93' for COMB and the AND gate 97' for COMA via the input signal line 9397. An output Q3 of the multi-level digital converter 154 is input to the AND gate 94' for COMB and the AND gate 98' for COMA via the input signal line 9498. As described above, the decoder 56' and the control logic 57 in the present specific example have a circuit configuration in which q0 and q4 in the first specific example are combined into Q0, q1 and q5 are combined into Q1, q2 and q6 are combined into Q2, and q3 and q7 are combined into Q3.

Figures 13A, 13B:
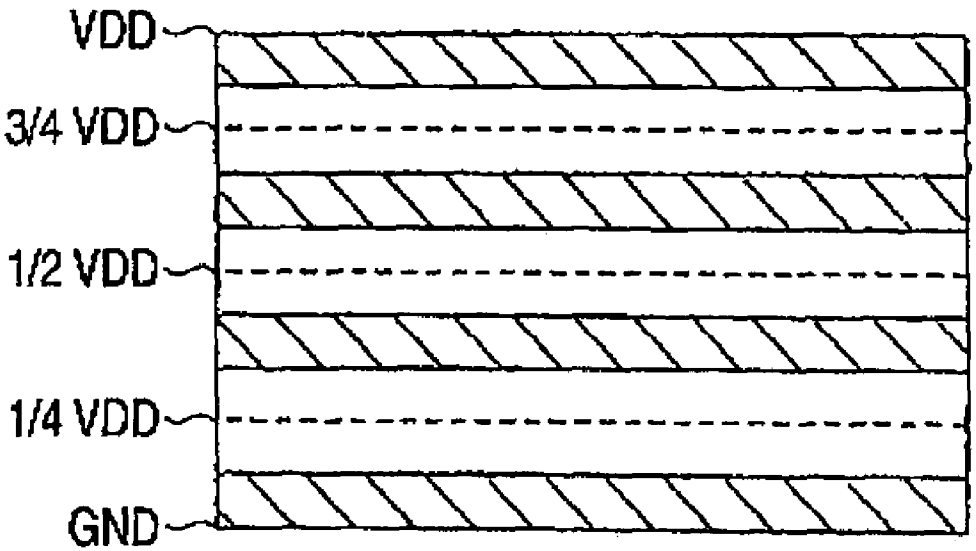
FIGS. 13A and 13B are views illustrating relationships between, in the third specific example, multi-level digital signals Q0 to Q3 and AND gates 91' to 98' which can cope with a multi-level digital signal.

The operations of the multi-level digital converters 151 to 154, and the AND gates 91' to 94' and 95' to 98' which can cope with a multi-level digital signal will be described with reference to FIGS. 13A and 13B. Hereinafter, the multi-level digital converter 151, and the AND gate 91' for COMB the AND gate 95' for COMA which can cope with a multi-level digital signal will be exemplarily described. As shown in FIGS. 12 and 13B, the multi-level digital converter 151 outputs the multi-level digital value Q0 in accordance with the values of the outputs q0' and q4' of the multiplexers 220*a* and 220*e*, and the enable signal EN. The case where the enable signal EN is "1" will be considered. When both the outputs q0' and q4' of the multiplexers 220*a* and 220*e* are "0" or [00] shown in FIG. 13B, the multi-level digital converter 151 outputs the multi-level digital value Q0=0. When the outputs q0' and q4' of the multiplexers 220*a* and 220*e* are "1" and "0", respectively or [10] shown in FIG. 13B, the multi-level digital converter 151 outputs the multi-level digital value Q0=(⅓)VDD. When the outputs q0' and q4' of the multiplexers 220*a* and 220*e* are "0" and "1", respectively or [01] shown in FIG. 13B, the multi-level digital converter 151 outputs the multi-level digital value Q0=(⅔)VDD. When the outputs q0' and q4' of the multiplexers 220*a* and 220*e* are "1" and "1", respectively or [11] shown in FIG. 13B, the multi-level digital converter 151 outputs the multi-level digital value Q0=VDD. Preferably, thresholds of the multi-level digital signal are set so as to have a certain degree of width with, for example, using GND, (¼)VDD, (½)VDD, (¾)VDD, and VDD as divisions as shown in FIG. 13A As described above, the output Q0 of the multi-level digital converter 151 is input to the AND gate 91' for COMB and the AND gate 95' for COMA via the input signal line 9195.

When the multi-level digital value Q0=0 is input to the AND gate 91' for COMB and the AND gate 95' for COMA, both the AND gate 91' for COMB and the AND gate 95' for COMA operate in the same manner as the case where the binary digital signal "0" is input to the AND gate 91 for COMB and the AND gate 95 for COMA in the above-described first specific example. Namely, irrespective of the values of the other inputs, both the AND gate 91' for COMB and the AND gate 95 for COMA do not output "1" but always output "0".

When the multi-level digital value Q0=(⅓)VDD is input to the AND gate 91' for COMB and the AND gate 95' for COMA, the AND gate 95' for COMA operates in the same manner as the case where the binary digital signal q0="1" is input to the AND gate 95 for COMA in the above-described first specific example. By contrast, the AND gate 91' for COMB operates in the same manner as the case where the binary digital signal q4="0" is input to the AND gate 91 for COMB in the above-described first specific example. Namely, the AND gate 95' for COMA outputs "1" depending on the other input conditions. Specifically, the AND gate 95' for COMA outputs "1" or "0" in accordance with the value of the data DH of the high order bit of the gray-scale data which is inverted and input from the second latch circuit 55, and that of the data DL of the low order bit of the gray-scale data which is inverted and input from the first latch circuit 54. By contrast, irrespective of the values of the other inputs, the AND gate 91' for COMB does not output "1" but always outputs "0".

When the multi-level digital value Q0=(⅔)VDD is input to the AND gate 91' for COMB and the AND gate 95' for COMA, the AND gate 95' for COMA operates in the same manner as the case where the binary digital signal q0="0" is input to the AND gate 95 for COMA in the above-described first specific example. By contrast, the AND gate 91' for COMB operates in the same manner as the case where the binary digital signal q4="1" is input to the AND gate 91 for COMB in the above-described first specific example. Namely, irrespective of the values of the other inputs, the AND gate 95' for COMA does not output "1" but always outputs "0". By contrast, the AND gate 91' for COMB outputs "1" depending on the other input conditions. Specifically, the AND gate 91' outputs "1" or "0" in accordance with the value of the data DH of the high order bit of the gray-scale data which is inverted and input from the second latch circuit 55, and that of the data DL of the low order bit of the gray-scale data which is inverted and input from the first latch circuit 54.

When the multi-level digital value Q0=VDD is input to the AND gate 91' for COMB and the AND gate 95' for COMA, both the AND gate 91' for COMB and the AND gate 95 for COMA operate in the same manner as the case where the binary digital signals q4=1 and q0=1 are input respectively to the AND gate 91 for COMB and the AND gate 95 for COMA in the above-described first specific example. Namely, both the AND gate 91' for COMB and the AND gate 95' for COMA output "1" depending on the other input conditions. Specifically, both the AND gates 91' and 95' output "1" or "0" in accordance with the value of the data DH of the high order bit of the gray-scale data which is inverted and input from the second latch circuit 55, and that of the data DL of the low order bit of the gray-scale data which is inverted and input from the first latch circuit 54.

Although the description is omitted, the AND gate 92' for COMB and the AND gate 96' for COMA, the AND gate 93' for COMB and the AND gate 97' for COMA, and the AND gate 94' for COMB and the AND gate 98' for COMA operate in the same manner. In the embodiment, such an AND gate which can operate as described above is referred to as "AND gate which can cope with a multi-level digital signal".

The relationships between the gray-scale data (DH, DL) shown in FIGS. 6 and 7 and the program data shown also in FIG. 12 are identical with those of the first specific example. Therefore, their descriptions are omitted.

In the third specific example, the decoder 56' and the control logic 57' can be configured in a simplified manner, and the number of pins in the case where they are incorporated into an IC can be reduced.

Next, an inkjet printer of another embodiment of the invention will be described. The configuration of the inkjet printer is substantially identical with that of the inkjet printer of the first embodiment, and hence the description thereof is omitted. In the first embodiment, the driving signal generating section 60 has the first driving signal generating circuit BOA and the second driving signal generating circuit 80B to generate the driving signals COMA, COMB shown in FIG. 5 each of which has plural driving pulses. By contrast, in the second embodiment, one of the driving signals COMA, COMB includes plural driving pulses. In the case where the first driving signal generating circuit BOA outputs the driving signal COMA which has the first driving pulse ADP1 placed in the term T1, and the second driving pulse ADP2 placed in the term T2 that follows the term T1, the second driving signal generating circuit 80B outputs a driving signal COMB which has one of the first driving pulse BDP1 placed in the term T1, and the second driving pulse BDP2 placed in the term T2 that follows the term T1.

According to the configuration, in the case where the driving signal COMB has only the second driving pulse BDP2, for example, it is possible to form a driving signal having a waveform in which the driving pulse ADP1 and the driving pulse BDP2 are combined with each other.

Alternatively, the second driving signal generating circuit BOB may output the driving signal COMB which has the first driving pulse BDP1 placed in the term T1, and the second driving pulse BDP2 placed in the term T2 that follows the term T1, and the first driving signal generating circuit 80A may output the driving signal COMA which has one of the first driving pulse ADP1 placed in the term T1, and the second driving pulse ADP2 placed in the term T2 that follows the term T1.

Next, an inkjet printer according to a third embodiment of the invention will be described. The configuration of the inkjet printer is substantially identical with the configurations of the inkjet printers of the first and second embodiments, and hence the description thereof is omitted. In the third embodiment; each of the driving signals COMA and COMB has one driving pulse. Namely, the first driving signal generating circuit 80A outputs a driving signal COMA which has the first driving pulse ADP1 placed in the term T1 or T2, and the second driving signal generating circuit 80B outputs a driving signal COMB which has the second driving pulse BDP2 placed in the term T1 or T2. Alternatively, the driving signal COMB may have the first driving pulse BDP1 in place of the second driving pulse BDP2.

According to the configuration, it is possible to form a driving signal such as that having a waveform in which the driving pulse ADP1 and the driving pulse BDP2 are combined with each other, or that having a waveform in which the driving pulse ADP2 and the driving pulse BDP1 are combined with each other.

In the first to third embodiments described above, the driving signal generating section 80 generates the two driving signals COMA, COMB. The invention is not restricted to this. The driving signal generating section may generate an n ($n \geqq 3$) or more number of driving signals, and one or more driving pulses in each of the n number of driving signals may be combined with each other.

According to the configuration, it is possible to obtain gray-scale levels the number of which is equal to that of the combinations of the driving pulses of the n number of driving signals.

While the invention has been illustrated and described with reference to specific preferred embodiments, it will be obvious to those skilled in the art that various changes and modifications can be made in the light of the above teachings. As defined in the appended claims, it is apparent that such changes and modifications lie within the spirit and scope of the invention or the intended range.

What is claimed is:

1. A liquid ejection apparatus, comprising:

a driving signal generating section operable to simultaneously generate, within a unit cycle having a plurality of pulse generating terms, a first driving signal having a plurality of first driving pulses and a second driving signal having a plurality of second driving pulses;

a driving pulse selecting section, operable to generate a third driving signal in which at most one of 1) one of the first driving pulses and 2) one of the second driving pulses is selected within each of the pulse generating terms; and driving elements, which are provided so as to respectively correspond to a plurality of nozzles, and operable to perform a driving operation to eject liquid droplets from the nozzles within the unit cycle on the basis of the third driving signal.

2. The liquid ejection apparatus as set forth in claim 1, further comprising a logic circuit constituting a logic causing the driving pulse selecting section to select at most one of 1) one of the first driving pulses and 2) one of the second driving pulses within one of the pulse generating terms.

3. The liquid ejection apparatus as set forth in claim 1, wherein the driving elements are piezoelectric vibrators.

4. The liquid ejection apparatus as set forth in claim 1, further comprising a driving pulse selecting signal generating section operable to generate a driving pulse selecting signal in accordance with an input data.

5. The liquid ejection apparatus as set forth in claim 4, wherein the driving pulse selecting signal includes a multi-level digital signal.

6. The liquid ejection apparatus as set forth in claim 4, wherein the driving pulse selecting section is turned off so as not to select the driving pulses in accordance with an enable signal.

7. A liquid ejection apparatus, comprising:

a driving signal generating section which generates a plurality of driving signals, each of the driving signals having at least one or more driving pulses;

a driving pulse selecting section, which selectively combines the driving pulses of the driving signals with each other;

driving elements, which are provided so as to respectively correspond to a plurality of nozzles, and which conduct a driving operation to eject liquid droplets from the nozzles on the basis of the combined driving pulses; and a driving pulse selecting signal generating section which generates a driving pulse selecting signal in accordance with an input data, wherein the driving pulse selecting section selectively combines the driving pulses of the driving signals with each other on the basis of the driving pulse selecting signal; and wherein the combination of the driving pulse selecting signal and the driving pulses of the driving signals is determined on the basis of a program data.

8. A liquid ejection apparatus, comprising:

a driving signal generating section which generates a plurality of driving signals, each of the driving signals having at least one or more driving pulses;

a driving pulse selecting section, which selectively combines the driving pulses of the driving signals with each other; and driving elements, which are provided so as to respectively correspond to a plurality of nozzles, and which conduct a driving operation to eject liquid droplets from the nozzles on the basis of the combined driving pulses, wherein a first driving signal of the driving signals includes a first driving pulse for ejecting a first liquid droplet and a second driving pulse for ejecting a second liquid droplet which is equal in amount to the first liquid droplet; and wherein a second driving signal of the driving signals includes a third driving pulse for ejecting a third liquid droplet which is smaller in amount than the first and second liquid droplets.

9. A liquid ejection head, comprising:

a driving pulse selecting section operable to generate a predetermined driving signal in which at most one of 1) one of a plurality of first driving pulses of a first driving signal and 2) one of a plurality of second driving pulses of a second driving signal which are simultaneously generated in a unit cycle having a plurality of pulse generating terms, is selected within each of the pulse generated term; and driving elements, which are provided so as to respectively correspond to a plurality of nozzles, and operable to perform a driving operation to eject liquid droplets from the plural nozzles within the unit cycle on the basis of the predetermined driving signal.

10. A liquid ejection method, comprising the steps of:

simultaneously generating, within a unit cycle having a plurality of pulse generating terms, a first driving signal, having a plurality of first driving pulses and a second driving signal having a plurality of second driving pulses;

generating a third driving signal in which at most one of 1) one of the first driving pulses 2) one of the second driving pulses is selected within each of the pulse generating terms; and performing a driving operation to eject liquid droplets from a plurality of nozzles within the unit cycle on the basis of the third driving signal.

11. The liquid ejection method as set forth in claim 10, further comprising:

generating a driving pulse selecting signal according to an input data.

12. The liquid ejection method as set forth in claim 11, wherein the driving pulse selecting signal includes a multi-level digital signal.

13. A liquid ejection method comprising:

generating a plurality of driving signals, each having at least one or more driving pulses;

selectively combining the driving pulses of the driving signals with each other;

ejecting liquid droplets from a plurality of nozzles on the basis of the combined driving pulses; and generating a driving pulse selecting signal according to an input data;

wherein;

in the step of combining the driving pulses, the driving pulses of the driving signals are selectively combined with each other on the basis of the driving pulse selecting signal; and the combination of the driving pulse selecting signal and the driving pulses of the driving signals is determined on the basis of a program data.

14. A liquid ejection method, comprising:

generating a plurality of driving signals, each having at least one or more driving pulses;

selectively combining the driving pulse of the driving signals with each other; and ejecting liquid droplets from a plurality of nozzles on the basis of the combined driving pulses, wherein;

a first driving signal of the driving signals includes a first driving pulse for ejecting a first liquid droplet and a second driving pulse for ejecting a second liquid droplet which is equal in amount to the first liquid droplet; and a second driving signal of the driving signals includes a third driving pulse for ejecting a third liquid droplet which is smaller in amount than the first and second liquid droplets.

* * * * *